US009405221B2

(12) United States Patent
Komatsu et al.

(10) Patent No.: US 9,405,221 B2
(45) Date of Patent: Aug. 2, 2016

(54) POWDER CONTAINER AND IMAGE FORMING APPARATUS INCORPORATING SAME

(71) Applicants: Makoto Komatsu, Kanagawa (JP); Tsukuru Kai, Kanagawa (JP); Hiroshi Hosokawa, Kanagawa (JP); Junichi Matsumoto, Kanagawa (JP); Tadashi Hayakawa, Kanagawa (JP); Yuzuru Ozawa, Kanagawa (JP)

(72) Inventors: Makoto Komatsu, Kanagawa (JP); Tsukuru Kai, Kanagawa (JP); Hiroshi Hosokawa, Kanagawa (JP); Junichi Matsumoto, Kanagawa (JP); Tadashi Hayakawa, Kanagawa (JP); Yuzuru Ozawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 103 days.

(21) Appl. No.: 13/900,850

(22) Filed: May 23, 2013

(65) Prior Publication Data

US 2013/0330105 A1 Dec. 12, 2013

(30) Foreign Application Priority Data

Jun. 8, 2012 (JP) ..... 2012-131218
Jun. 8, 2012 (JP) ..... 2012-131349

(51) Int. Cl.
*G03G 15/08* (2006.01)

(52) U.S. Cl.
CPC ..... *G03G 15/0832* (2013.01); *G03G 15/0862* (2013.01); *G03G 15/0865* (2013.01); *G03G 15/0868* (2013.01); *G03G 15/0886* (2013.01)

(58) Field of Classification Search
CPC ..... G03G 15/0867; G03G 15/0865; G03G 15/0832; G03G 15/0868; G03G 15/0886; G03G 15/0862
USPC ..... 399/106, 262
See application file for complete search history.

(56) References Cited

U.S. PATENT DOCUMENTS

| | | | |
|---|---|---|---|
| 5,495,323 | A | 2/1996 | Meetze, Jr. |
| 6,169,864 | B1 | 1/2001 | Baxendell et al. |
| 7,248,825 | B2 | 7/2007 | Nishitani et al. |
| 2001/0021326 | A1 | 9/2001 | Yanagisawa et al. |
| 2002/0114646 | A1 | 8/2002 | Sudo et al. |

(Continued)

FOREIGN PATENT DOCUMENTS

| | | |
|---|---|---|
| JP | 7-020705 | 1/1995 |
| JP | 7-199632 | 8/1995 |

(Continued)

OTHER PUBLICATIONS

Kato. JP H11-327275 Machine Translation. Published Nov. 1999. Accessed/translated Jan. 2015.*

(Continued)

*Primary Examiner* — Walter L Lindsay, Jr.
*Assistant Examiner* — Philip Marcus T Fadul
(74) *Attorney, Agent, or Firm* — Oblon, McClelland, Maier & Neustadt, L.L.P

(57) ABSTRACT

A powder container includes a rotatable powder chamber for containing powder used for forming images, having an opening on a first side in an axial direction of the powder container, a conveyor to transport powder contained in the powder chamber to the first side from a second side in the axial direction, a protrusion radially projecting from an outer circumferential surface of the powder chamber, disposed in a circumferential area of the powder chamber, and a facing member disposed facing the outer circumferential surface of the powder chamber. The protrusion contacts the facing member as the powder chamber rotates.

23 Claims, 21 Drawing Sheets

(56) References Cited

U.S. PATENT DOCUMENTS

| | | | | |
|---|---|---|---|---|
| 2004/0223790 | A1 | 11/2004 | Hosokawa et al. | |
| 2004/0247343 | A1 | 12/2004 | Matsumoto et al. | |
| 2007/0147900 | A1 | 6/2007 | Taguchi et al. | |
| 2007/0147902 | A1 | 6/2007 | Taguchi et al. | |
| 2007/0154244 | A1 | 7/2007 | Taguchi et al. | |
| 2008/0193169 | A1* | 8/2008 | Teramura | 399/262 |
| 2009/0185824 | A1* | 7/2009 | Murakami et al. | 399/120 |
| 2010/0209141 | A1* | 8/2010 | Ikado | 399/119 |
| 2011/0020039 | A1 | 1/2011 | Mitsuishi et al. | |

FOREIGN PATENT DOCUMENTS

| | | | |
|---|---|---|---|
| JP | 08-095361 | A | 4/1996 |
| JP | 8-220857 | | 8/1996 |
| JP | 9-211977 | | 8/1997 |
| JP | 10-221943 | A | 8/1998 |
| JP | 10-254229 | | 9/1998 |
| JP | 11-327275 | | 11/1999 |
| JP | 2003-241492 | A | 8/2003 |
| JP | 2004-012687 | | 1/2004 |
| JP | 2004-280064 | | 10/2004 |
| JP | 2005-099434 | | 4/2005 |
| JP | 2006-072166 | | 3/2006 |
| JP | 2006-258997 | A | 9/2006 |
| JP | 2007-065613 | | 3/2007 |
| JP | 2007-140433 | | 6/2007 |
| JP | 2007-178969 | | 7/2007 |
| JP | 2008-292936 | A | 12/2008 |
| JP | 2011-027934 | | 2/2011 |
| JP | 2012-042533 | A | 3/2012 |

OTHER PUBLICATIONS

Office Action issued Mar. 11, 2016 in Japanese Patent Application No. 2012-131218.

Office Action issued Mar. 18, 2016 in Japanese Patent Application No. 2012-131349.

* cited by examiner

POWDER CONTAINER AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2012-131349, filed on Jun. 8, 2012, and 2012-131218, filed on Jun. 8, 2012, in the Japan Patent Office, the entire disclosure of each of which is hereby incorporated by reference herein.

BACKGROUND

1. Technical Field

The present invention generally relates to a powder container including a rotatable powder chamber for containing powder, and further to a powder replenishing device and an image forming apparatus incorporating the powder container.

2. Description of the Background Art

There are powder replenishing devices, such as toner replenishing devices for supplying toner to an image forming apparatus, that use a powder container including a bottle body, serving as a powder chamber, for containing toner, and a front end cover, serving as a holding portion, for rotatably holding a front end portion of the bottle body.

In such configurations, typically a container gear is formed on a circumference of the front end portion of the bottle body to mesh with a driving gear provided in a body of an image forming apparatus (i.e., an apparatus body). As the bottle body rotates with the container gear meshing with the driving gear, toner contained inside the bottle body moves from a rear side to a front side of the bottle body along a spiral protrusion formed on an inner circumferential surface of the bottle body. In the front end portion, toner enters a hopper formed in a front end portion of the front end cover covering the bottle body. A nozzle inserted into the hopper from outside the front end cover, sucks in toner and transports the toner to a developing device incorporated in the image forming apparatus.

In such a configuration, it is possible that toner coagulate inside the bottle body if the apparatus is not used for a long time. Various approaches have been tried to loosen coagulated toner in the bottle body. For example, JP-H11-327275-A proposes a toner replenishing device that includes a cylindrical bottle holder having a diameter greater than that of the bottle body, and a rear end portion of the bottle body is inserted into the cylindrical bottle holder.

At a predetermined circumferential position of the bottle holder, an internal projection projects from an inner circumferential surface of the bottle holder, and a protrusion is formed in the rear end portion of the bottle body, at a predetermined circumferential position. When the protrusion of the rear end portion of the bottle body moves in a predetermined rotational range as the bottle body rotates, the protrusion overstrides the internal projection of the bottle holder. An impact at that time can vibrate the bottle body to loosen the toner therein.

SUMMARY

In view of the foregoing, one embodiment of the present invention provides a powder container that includes a rotatable powder chamber for containing powder used for forming images, having an opening on a first side in an axial direction of the powder container, a conveyor disposed inside the powder chamber to transport powder contained in the powder chamber to the first side from a second side in the axial direction, a protrusion radially projecting from an outer circumferential surface of the powder chamber, disposed in a circumferential area of the powder chamber, and a first facing member disposed facing the outer circumferential surface of the powder chamber. The protrusion contacts the first facing member as the powder chamber rotates.

In another embodiment, an image forming apparatus includes an image forming unit to form images on recording media, and the above-described powder container.

In yet another embodiment, a powder container includes a powder chamber for containing powder for forming images, having an opening on a first side in a longitudinal direction of the powder container, a conveyor disposed inside the powder chamber to transport the powder contained in the powder chamber to the first side from a second side in an axial direction, an end cover to cover an end portion of the powder chamber in which the opening is formed, and a retainer to retain the powder container. A retaining hole is formed in the end cover, and the retainer penetrates the retaining hole of the end cover and contacts an outer circumferential surface of the powder chamber.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
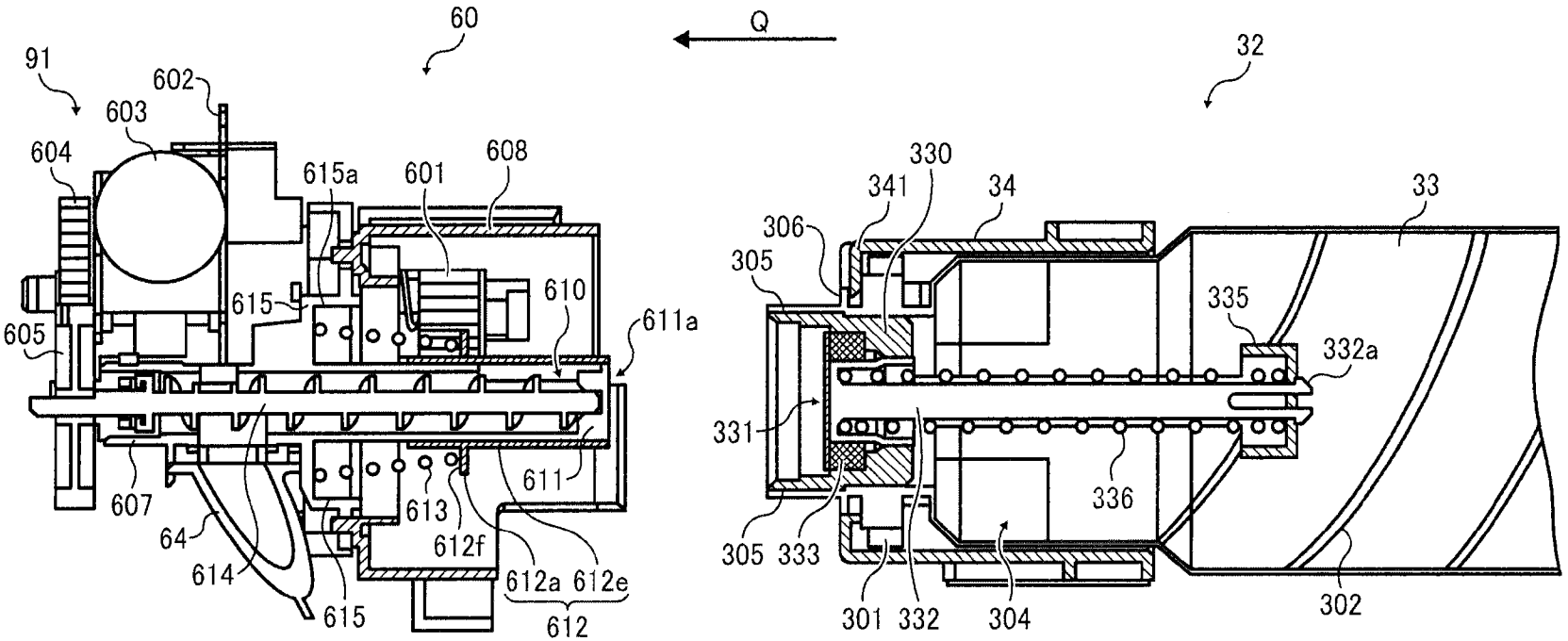
FIG. 1 is a longitudinal sectional view of a toner replenishing device and a front end portion of a toner container to be attached thereto, according to a first embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, a toner container, a toner replenishing device, and an image forming apparatus according to a first embodiment of the present invention is described.

According to the embodiments of the present invention described below, coagulation of powder contained in the powder container can be loosened without causing a substantial eccentric movement of the powder chamber therein.

First Embodiment

Figure 2:
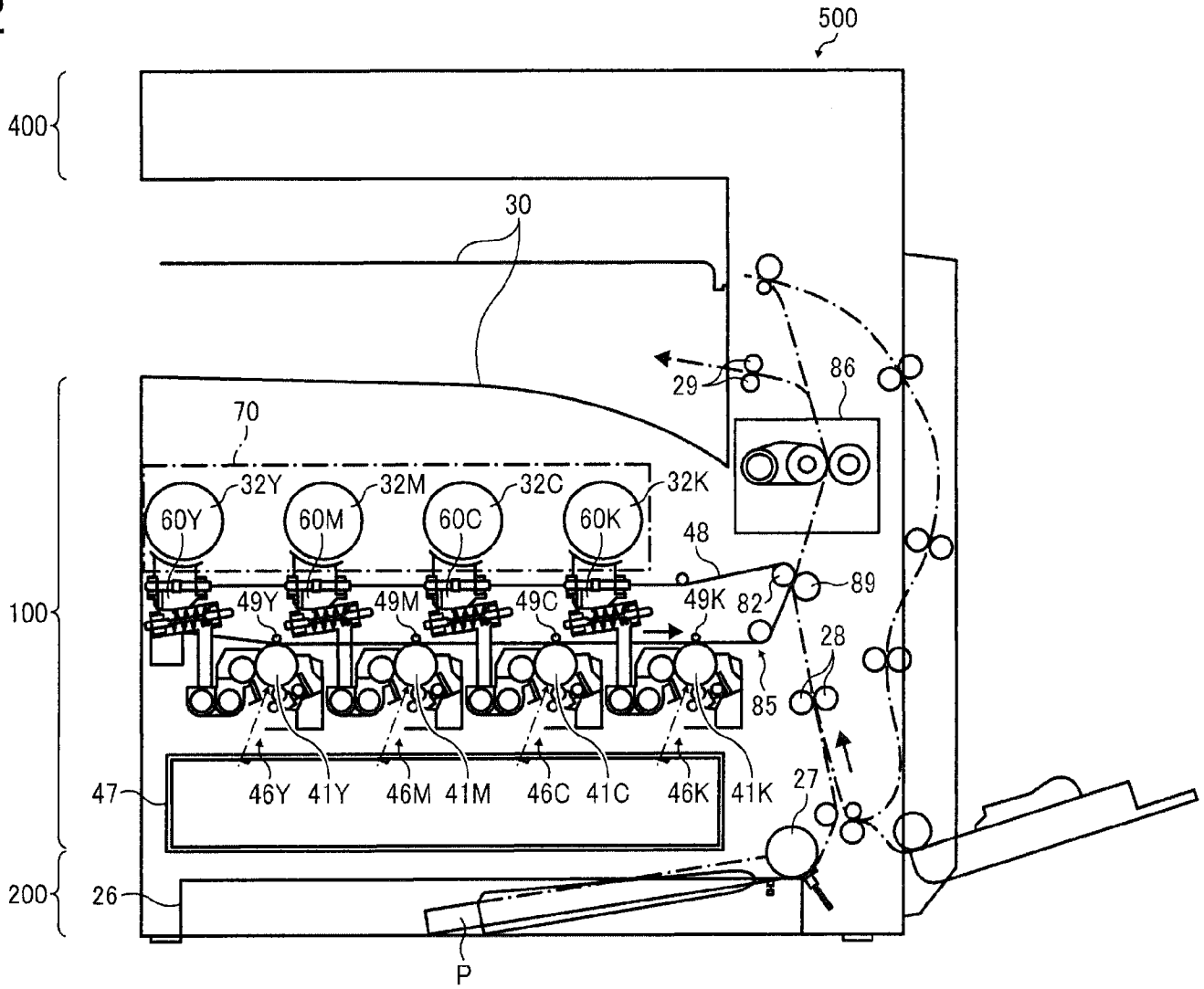
FIG. 2 is a schematic diagram illustrating a configuration of an image forming apparatus according to the first embodiment.

FIG. 1 illustrates a front end portion of the toner container and the toner replenishing device according to the first embodiment, and FIG. 2 is a schematic diagram illustrating a configuration of the image forming apparatus according to the first embodiment.

Referring to FIG. 2, an image forming apparatus 500 according to the first embodiment can be an electrophotographic multicolor copier, for example. The image forming apparatus 500 includes an apparatus body or printer unit 100, a sheet-feeding table or sheet feeder 200, and a scanner 400 provided above the apparatus body 100.

The image forming apparatus 500 includes a container frame 70 provided in an upper section of the apparatus body 100. Four toner containers 32Y, 32M, 32C, and 32K for containing yellow, magenta, cyan, and black toners, respectively, are removably installable in the container frame 70. That is, the toner containers 32Y, 32M, 32C, and 32K are replaceable. An intermediate transfer unit 85 is provided beneath the container frame 70.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

The intermediate transfer unit 85 includes an intermediate transfer belt 48, four primary-transfer bias rollers 49, a secondary-transfer backup roller 82, multiple tension rollers, and a belt cleaning unit. The intermediate transfer belt 48 is supported by the multiple rollers including the secondary-transfer backup roller 82 and is rotated in the direction indicated by an arrow shown in FIG. 2 as the secondary-transfer backup roller 82 rotates.

The apparatus body 100 includes four image forming units 46 parallel to each other, facing the intermediate transfer belt 48. Additionally, toner replenishing devices 60 corresponding to the respective toner containers 32 are provided beneath the toner containers 32. Each toner replenishing device 60 supplies toner from the corresponding toner container 32 to a developing device 50 (shown in FIG. 3) of the corresponding image forming unit 46.

As shown in FIG. 2, an exposing device 47 is provided beneath the four image forming units 46. The exposing device 47 exposes a surface of a drum-shaped photoreceptor 41 according to image data read by the scanner 400 or that externally acquired by external devices such as computers, thereby forming an electrostatic latent image thereon. Although the exposing device 47 in the configuration shown in FIG. 2 employs laser beam scanning using a laser diode, other configurations such as those using light-emitting diode (LED) arrays may be used.

Figure 3:
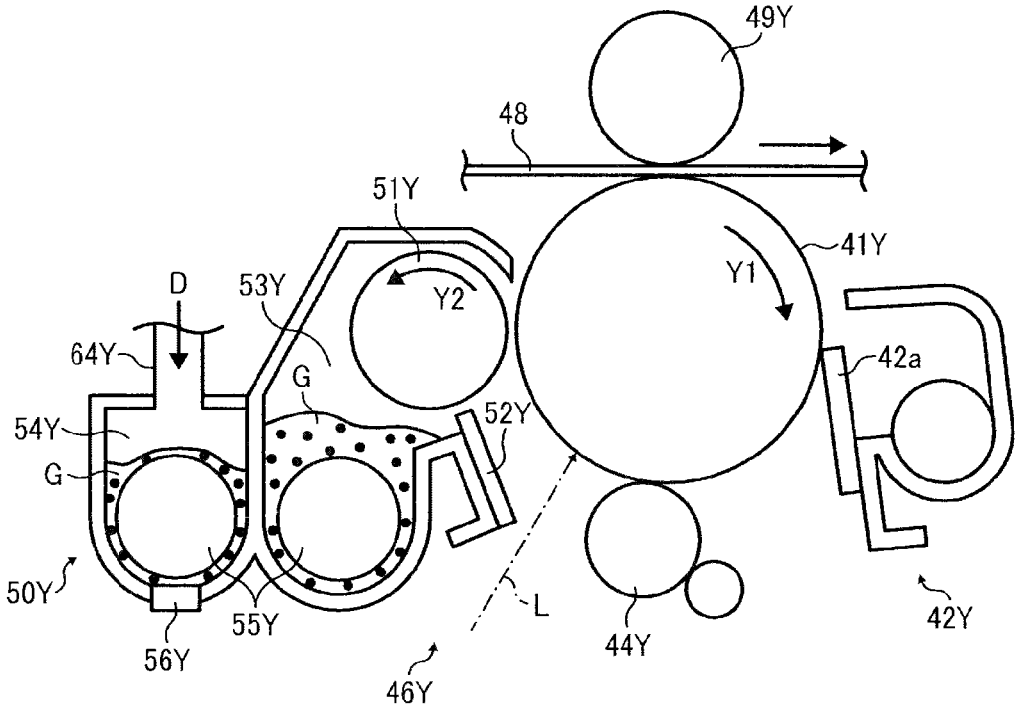
FIG. 3 is a schematic end-on axial view of an image forming unit for yellow of the mage forming apparatus shown in FIG. 2.

FIG. 3 is a schematic end-on axial view of the image forming unit 46Y for yellow. The image forming unit 46Y includes the drum-shaped photoreceptor 41Y serving as a latent image bearer. Around the photoreceptor 41Y, a charging roller 44Y serving as a charging member, the developing device 50Y, a photoreceptor cleaning device 42Y, and a discharger are provided. Image forming processes, namely, charging, exposure, image development, image transfer, and cleaning processes are performed on the photoreceptor 41Y, and thus a yellow toner image is formed on the photoreceptor 41Y.

It is to be noted that other image forming units 46 have a similar configuration to that of the yellow image forming unit 46Y except the color of the toner used therein and form toner images of the respective colors. Thus, only the image forming unit 46Y is described below and descriptions of other image forming units are omitted.

Referring to FIG. 3, the photoreceptor 41Y is rotated clockwise in FIG. 3 as indicated by arrow Y1 by a driving motor. The surface of the photoreceptor 41Y is charged uniformly at a position facing the charging roller 41Y by the charging roller 41Y (charging process). When the photoreceptor 41Y reaches a position to receive a laser beam L emitted from the exposing device 47, the photoreceptor 41Y is scanned with the laser beam L, and thus an electrostatic latent image for yellow is formed thereon (exposure process). Then, the photoreceptor 41Y reaches a position facing the developing device 50Y, where the latent image is developed with toner into a yellow toner image (development process).

The four primary-transfer bias rollers 49 sandwich the intermediate transfer belt 48 with the corresponding photoreceptors 41, respectively, forming primary-transfer nips therebetween. Each primary-transfer bias roller 49 receives a transfer bias whose polarity is opposite the charge polarity of the toner.

At the position facing the primary-transfer bias roller 49Y via the intermediate transfer belt 48, the toner image is transferred from the photoreceptor 41Y onto the intermediate transfer belt 48 (primary-transfer process). After the primary-transfer process, a certain amount of toner tends to remain on the photoreceptor 41Y. Then, a cleaning blade 42*a* mechanically collects toner remaining on the photoreceptor 41Y (cleaning process) at the position facing the photoreceptor cleaning device 42Y. Subsequently, the discharger removes potentials remaining on the surface of the photoreceptor 41Y. Thus, a sequence of image forming processes performed on the photoreceptor 41Y is completed.

The above-described image forming processes are performed also in the image forming units 46M, 46C, and 46K similarly. That is, the exposing device 47 disposed above the image forming units 46 in FIG. 2 directs the laser beams L according to image data onto the photoreceptors 41 in the respective image forming units 46. Specifically, the exposing device 47 includes light sources to emit the laser beams L, multiple optical elements, and a polygon mirror that is rotated by a motor. The exposing device 47 directs the laser beams L to the respective photoreceptors 41 via the multiple optical elements while deflecting the laser beams L with the polygon mirror.

The intermediate transfer belt 48 rotates in the direction indicated by the arrow shown in FIG. 2 and sequentially passes through the respective primary-transfer nips. While the intermediate transfer belt 48 thus rotates, the toner images formed on the respective photoreceptors 41 are transferred from the photoreceptors 41 and superimposed one on another on the intermediate transfer belt 48, forming a multicolor toner image.

Then, the intermediate transfer belt 48 carrying the multicolor toner image reaches a position facing a secondary-transfer roller 89 disposed facing the secondary-transfer backup roller 82. The secondary-transfer backup roller 82 and the secondary-transfer roller 89 press against each other via the intermediate transfer belt 48, and the contact portion therebetween is hereinafter referred to as a secondary-transfer nip. The multicolor toner image on the intermediate transfer belt 48 is transferred onto the sheet P (recording medium) transported to the secondary-transfer nip. A certain amount of toner tends to remain on the intermediate transfer belt 48 after the secondary-transfer process. The belt cleaning unit collects untransferred toner remaining on the intermediate transfer belt 48, and thus a sequence of transfer processes performed on the intermediate transfer belt 48 is completed.

Next, sheet conveyance is described below.

The sheet P is transported by a sheet tray 26 of the sheet feeder 200 positioned beneath the apparatus body 100 to the secondary-transfer nip via a feed roller 27 and a registration roller pair 28. More specifically, the sheet tray 26 contains multiple sheets P piled one on another. The feed roller 27 rotates counterclockwise in FIG. 2 to feed the sheet P on the top in the sheet tray 26 toward a nip formed by the registration roller pair 28.

The registration roller pair 28 stops rotating temporarily, stopping the sheet P with a leading edge of the sheet P stuck in the nip. The registration roller pair 28 resumes rotation to transport the sheet P to the secondary-transfer nip, time to coincide with the arrival of the multicolor toner image formed on the intermediate transfer belt 48. Thus, the multicolor toner image is recorded on the sheet P.

Subsequently, the sheet P is transported to a fixing device 86. In the fixing device 86, a fixing belt and a pressing roller apply heat and pressure to the sheet P to fix the multicolor toner image on the sheet P. Subsequently, the sheet P is discharged by a discharge roller pair 29 outside the image forming apparatus 500 and stacked as an output image in a stack section 30. Thus, a sequence of image forming processes performed in the image forming apparatus 500 is completed.

Next, a configuration and operation of the developing device 50Y in the image forming unit 46Y are described in further detail below. The image forming units 46 for other colors and the developing devices 50 therein are configured similarly, and thus descriptions thereof are omitted.

The developing device 50Y includes a developing roller 51Y disposed facing the photoreceptor 41Y, a doctor blade 52Y disposed facing the developing roller 51Y, two developer conveying screws 55Y respectively disposed in first and second developer reservoirs 53Y and 54Y, and a toner density sensor 56Y to detect the density of toner in the second developer reservoir 54Y. A casing of the developing device 50Y is divided, at least partially, into the first and second developer reservoirs 53Y and 54Y. The developing roller 51Y includes a stationary magnet roller or multiple magnets and a sleeve that rotates around the magnet roller, and the like. The first and second developer reservoirs 53Y and 54Y contain two-component developer G consisting essentially of carrier (carrier particles) and toner (toner particles). Additionally, the second developer reservoir 54Y communicates, via an opening formed on an upper side thereof, with a vertical toner tube 64Y forming a toner conveyance channel through which toner is supplied from the toner container 32Y as indicated by arrow D.

Inside the developing device 50Y, the developer G is agitated by the two developer conveying screws 55Y and circulated between the first and second developer reservoirs 53Y and 54Y. While being transported by the developer conveying screw 55Y, the developer G in the first developer reservoir 53Y is attracted by magnetic fields generated by the magnet roller inside the developing roller 51Y and carried onto the sleeve surface of the developing roller 51Y. The developer G carried on the developing roller 51Y moves in the circumferential direction of the developing roller 51Y as the sleeve of the developing roller 51Y rotates counterclockwise in FIG. 3 as indicated by arrow Y2. At that time, toner particles in developer G are charged through friction with carrier particles to have a potential in the polarity opposite the polarity of carrier particles. Then, the toner particles are adsorbed to the carrier particles and carried on the developing roller 51Y together with the carrier particles by the magnetic field generated on the developing roller 51Y.

The developer G carried on the developing roller 51Y is transported as indicated by arrow Y2 in FIG. 3 to a position where the doctor blade 52Y faces the developing roller 51Y. Then, the amount of developer G on the developing roller 51Y is adjusted to a suitable amount by the doctor blade 52Y, after which the developer G is carried to a development range facing the photoreceptor 41Y. In the development range, the toner in developer G adheres to the latent image formed on the photoreceptor 41Y due to the effect of the magnetic field generated between the developing roller 51Y and the photoreceptor 41Y. As the sleeve rotates, the developer G remaining on the developing roller 51Y reaches an upper part in the first developer reservoir 53Y and then drops from the developing roller 51Y.

The concentration of toner in developer G contained in the developing device 50Y is adjusted within a predetermined range. More specifically, the toner replenishing device 60Y (shown in FIG. 4), described later, supplies toner from the toner container 32Y to the second developer reservoir 54Y according to the consumption of toner in the developing device 50Y. Inside the developing device 50Y, toner is mixed with the developer G is by the developer conveying screws 55Y and circulated between the first and second developer reservoirs 53Y and 54Y.

Next, a configuration of the toner replenishing devices 60 is described below.

Figure 4:
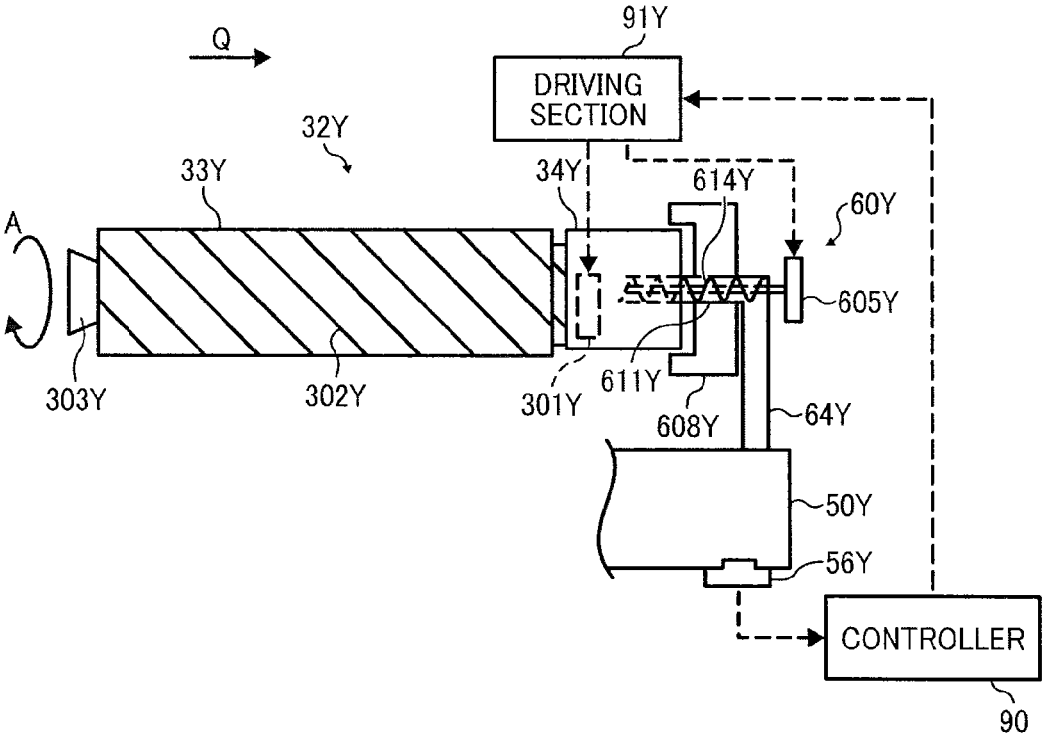
FIG. 4 is a schematic diagram illustrating the toner replenishing device and the toner container connected thereto, included in the image forming apparatus shown in FIG. 2.
Figure 5:
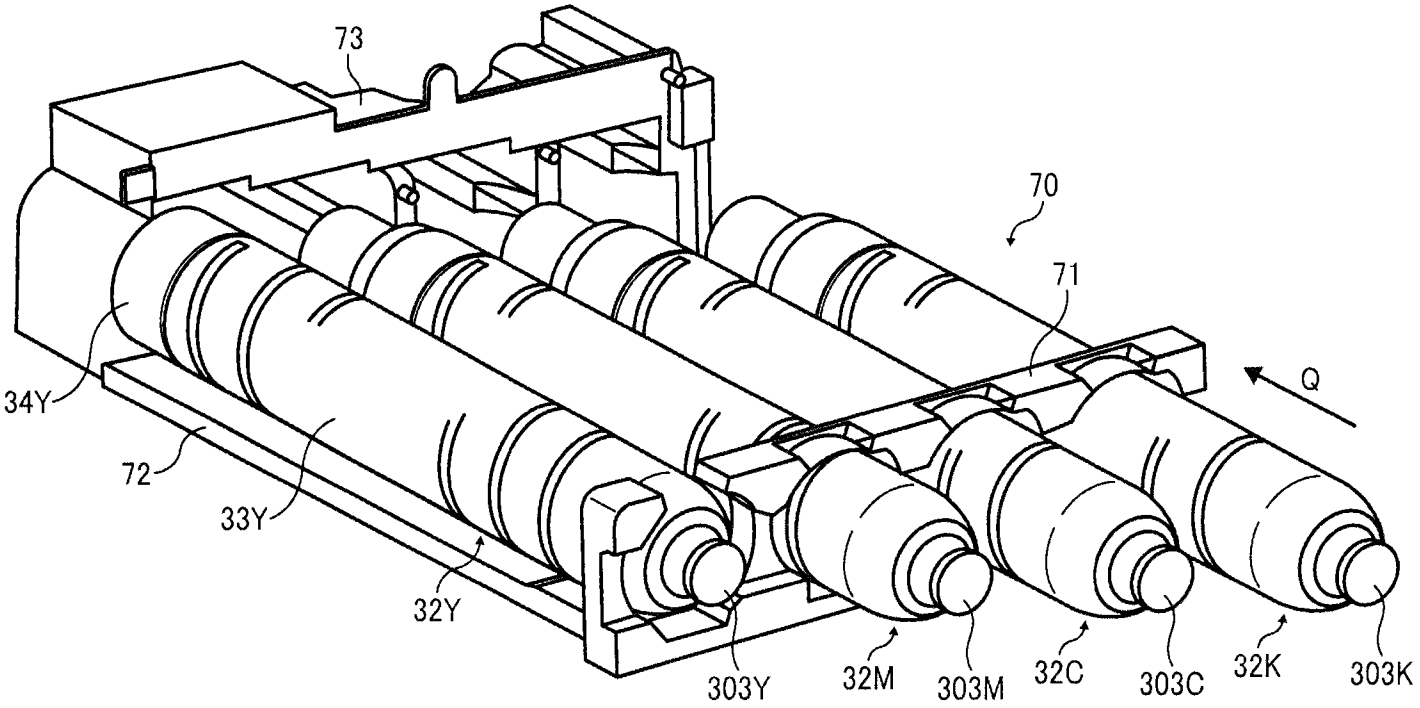
FIG. 5 is a perspective view of a container frame of the image forming apparatus shown in FIG. 2, together with the toner containers mounted therein.

FIG. 4 illustrates the toner replenishing device 60Y and the toner container 32Y connected thereto, and FIG. 5 is a perspective view illustrating the container frame 70 to which the toner containers 32 are mounted.

The respective color toners contained in the toner containers 32Y, 32M, 32C, and 32K in the container frame 70 are supplied to the developing devices 50Y, 50M, 50C, and 50K by the toner replenishing devices 60Y, 60M, 60C, and 60K according to the amount of the corresponding toner consumed. It is to be noted that the toner replenishing devices 60Y, 60M, 60C, and 60K have a similar structure, and the toner containers 32Y, 32M, 32C, and 32K have a similar structure except the color of toner used. Therefore, only the structure for yellow is shown in FIG. 4, omitting structures for other colors.

Each toner replenishing device 60 includes a conveying nozzle 611, a conveying screw 614, the vertical toner tube 64, and a driving section 91, and is connected to the toner container 32 installed in the container frame 70.

In conjunction with insertion of the toner container 32 into the container frame 70 of the apparatus body 100 in the direction indicated by arrow Q shown in FIG. 4 (hereinafter "installation direction Q"), the conveying nozzle 611 of the toner replenishing device 60 is inserted into the toner container 32 from the front side of the toner container 32. Thus, the conveying nozzle 611 communicates with the interior of the toner container 32.

The toner container 32 is cylindrical and constructed of a bottle body 33, which can be monolithic with a container gear 301, and a container front cover 34. The container front cover 34 is fixed stationary to the container frame 70, not to rotate. The container front cover 34 receives a front end portion of the bottle body 33 in its axial direction, meaning the direction in which the axis of rotation extends, and holds the front end portion rotationally.

The container frame 70 is constructed with a container cover section 73 to receive the container front covers 34 of the respective toner containers 32, a container body section 72 that receives the bottle bodies 33 of the toner containers 32, and an insertion section 71 having four insertion openings through which the toner containers 32 are inserted into and removed from the toner container frame 70. It is to be noted that the container cover section 73 of the container frame 70 includes container sockets (or container fitting, container holder; container brackets) 608 (608Y in FIG. 4). The container sockets 608 are designed to receive the front end portions of the respective toner containers 32.

Referring again to FIG. 2, when a front cover of the image forming apparatus 500 (on the front side of the paper on which FIG. 2 is drawn) is opened, the insertion section 71 of the toner container frame 70 is exposed. The toner containers 32 are inserted and removed on the front side of the image forming apparatus 500 with the long axis of the toner containers 32 kept horizontal.

The longitudinal length of the container body section 72 of the container frame 70 is almost equal to the longitudinal length of the bottle body 33. In addition, the container cover section 73 is positioned on one side in the longitudinal direction of the container body section 72 (on the leading side or downstream side in the direction of insertion), and the insertion section 71 is positioned on the other side (on the upstream side) of the container body section 72. While the toner container 32 is being inserted into the container frame 70, the container front cover 34 passes through the insertion section 71, slides on the container body section 72 for a certain distance, and then is set in the container cover section 73.

With the container front cover 34 held in the container cover section 73, the bottle body 33 is rotated by the driving section 91 in the direction indicated by arrow A (hereinafter "direction A") shown in FIG. 4. The driving section includes a driving motor, a driving gear, and the like transmits driving force to the container gear 301.

A spiral protrusion 302 protrudes inward from an inner circumferential surface of the bottle body 33. With this configuration, as the bottle body 33 rotates, toner inside the bottle body 33 is transported in the longitudinal direction thereof (from the left to the right in FIG. 4) and is sent out from the container front cover 34 into the conveying nozzle 611.

The conveying screw 614 is disposed inside the conveying nozzle 611. When the driving section 91 inputs driving force to a screw gear 605, the conveying screw 614 rotates, thus transporting toner inside the conveying nozzle 611. The toner conveyed by the conveying screw 614 drops under its own weight through the vertical toner tube 64 (see FIG. 4) and is supplied to the developing device 50, in particular, to the second developer reservoir 54.

It is to be noted that the toner container 32Y, 32M, 32C, and 32K are replaced when the respective service lives thereof have expired, that is, when almost all toner in the toner container 32 have been consumed. A handle 303 is provided at the end of the bottle body 33 on the side opposite the container front cover 34, and users can grasp the handle 303 to remove the toner container 32 from the image forming apparatus 500 in replacement.

Toner is supplied to the developing device 50 from the toner container 32 when a controller 90 deems that toner supply is required from the toner consumption calculated according to image data used by the exposing device 47 or detection results generated by the toner density sensor 56. Specifically, the controller 90 drives the driving section 91 to rotate the bottle body 33 and the conveying screw 614 for a predetermined time period, thereby supplying toner to the developing device 50.

Since the conveying screw 614 inside the conveying nozzle 611 is rotated to supply toner, the amount of toner supplied from the toner container 32 can be calculated accurately by detecting the number of rotation of the conveying screw 614. For example, the amount of supplied toner can be calculated accumulatively from when the toner container 32 is installed in the image forming apparatus 500. When the accumulative amount of supplied toner reaches the amount of toner contained in the toner container 32 at the time of installation, the controller 90 deems that the toner container 32 is empty, which is a state referred to as "toner end". Then, the controller 90 causes a display of the image forming apparatus 500 to instruct the user to replace the toner container 32. Additionally, this message can be displayed also when the concentration of toner does not recover to a desired concentration even after toner supply is repeated, deeming that the toner container 32 is empty.

When the amount of supplied toner is controlled based on the number of rotation of the conveying screw 614, the mount of toner is not adjusted after toner passes through the conveying nozzle 611, and supplied as is to the developing device 50 through the vertical toner tube 64. Even in the configuration in which the conveying nozzle 611 is inserted into the toner container 32, a temporary toner reservoir such as a toner hopper may be provided, and the amount of toner supplied to the developing device 50 may be controlled by changing the amount of toner transported from the temporary toner reservoir to the developing device 50.

Although the conveying screw 614 is used in the description above, toner in the conveying nozzle 611 may be transported using a different configuration. For example, negative pressure may be generated at the opening of the conveying nozzle 611 using a powder pump to give conveyance force to toner.

In configurations including the temporary toner reservoir, typically a toner end detector is provided to detect that the amount of toner remaining in the temporary toner reservoir falls below a threshold. According to the detection by the toner end detector, the bottle body 33 as well as the conveying screw 614 is rotated for a predetermined period to supply toner to the temporary toner reservoir.

If the toner end detector continues to report "toner end" even when this operation is repeated a predetermined number of times, the controller 90 causes the display of the image forming apparatus to instruct users to replace the toner container 32, deeming that the toner container 32 is empty. Cumulative calculation of supplied toner from the installation of the toner container 32 is not required in the configuration in which whether any toner remains inside the toner container 32 is judged based on the detection by the toner end detector. However, the toner replenishing device 60 according to the present embodiment, which does not include the temporary toner reservoir, is advantageous in that the toner replenishing device 60 can be more compact, thereby reducing the size of the image forming apparatus 500.

Next, the toner container 32 and the toner replenishing device 60 are described in further detail. As described above, the four toner containers 32 and the four toner replenishing devices 60 have similar configurations except the color of toner contained therein.

Figure 6:
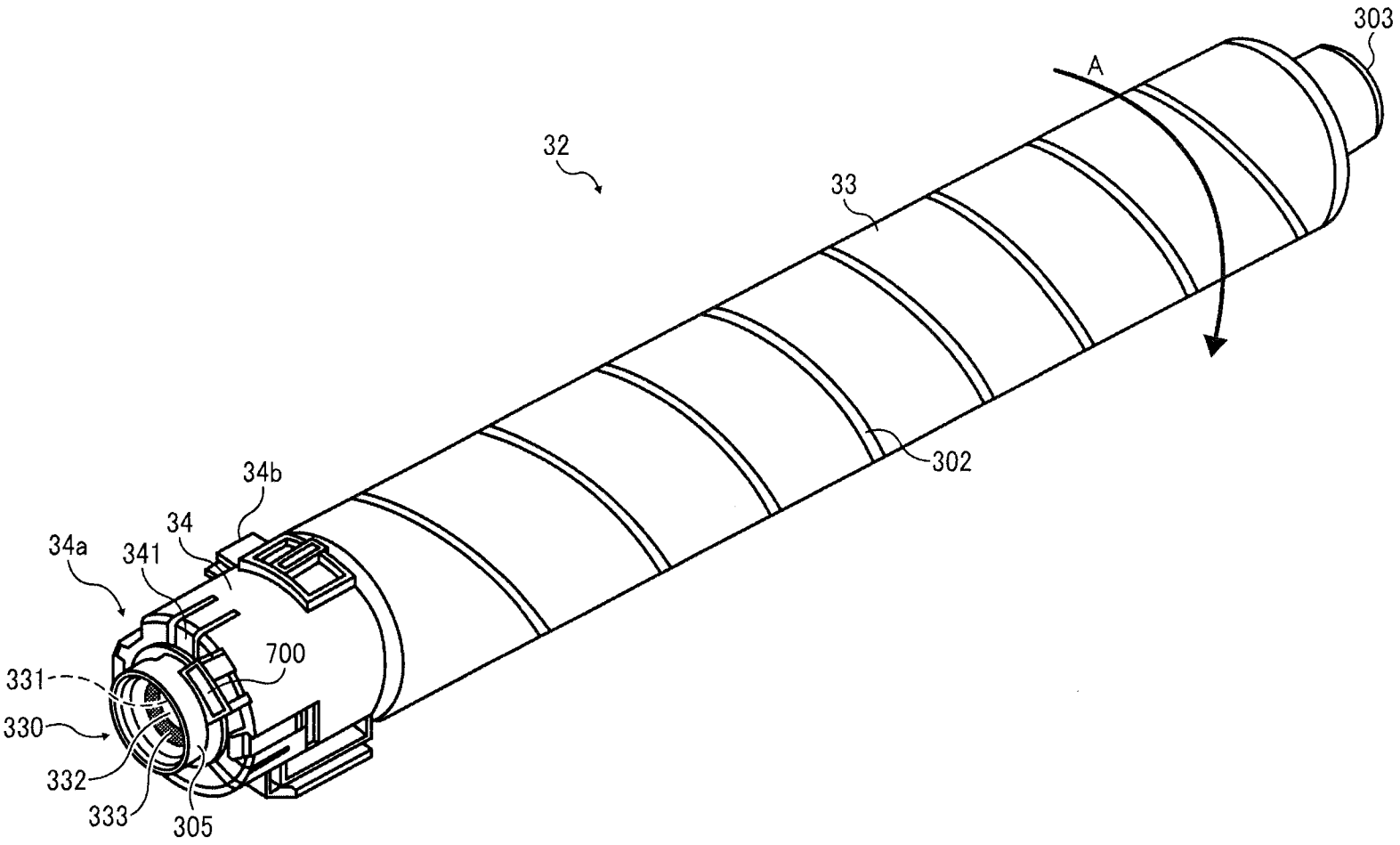
FIG. 6 is a perspective view of the toner container according to the first embodiment.
Figure 7:
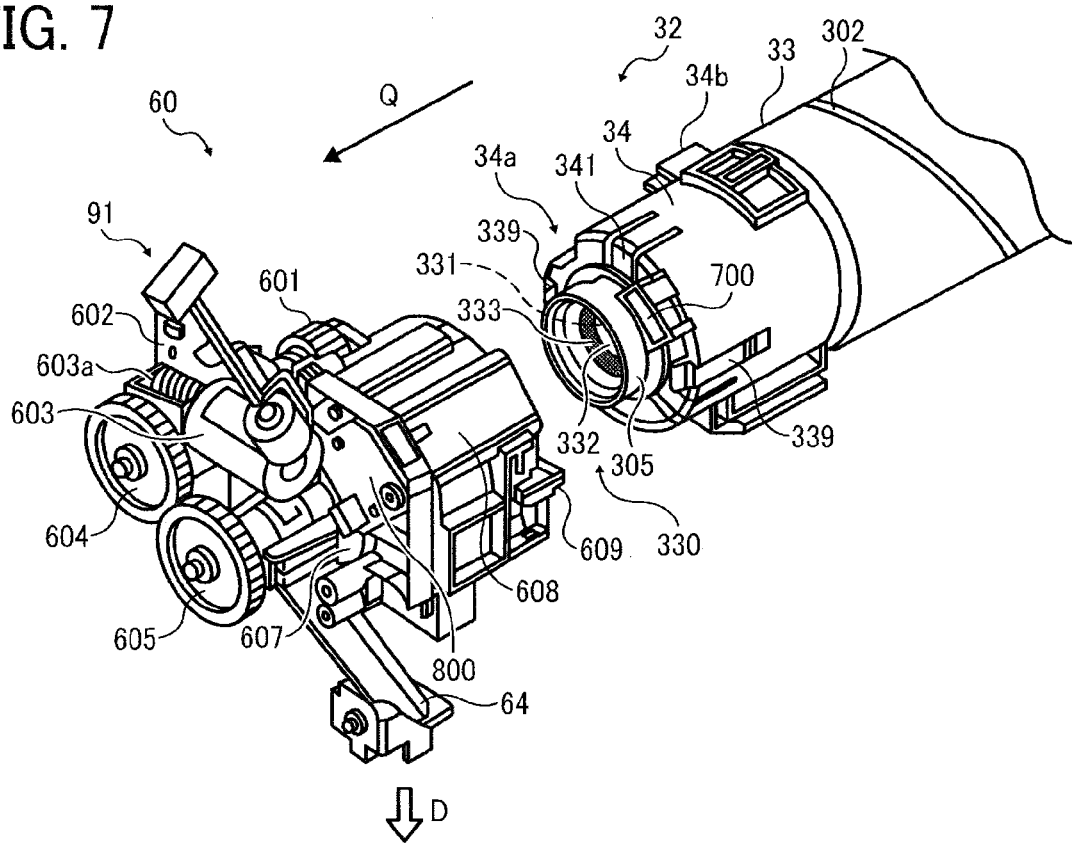
FIG. 7 illustrates an enlarged perspective view of the toner replenishing device and the front end portion of the toner container to be attached thereto.
Figure 8:
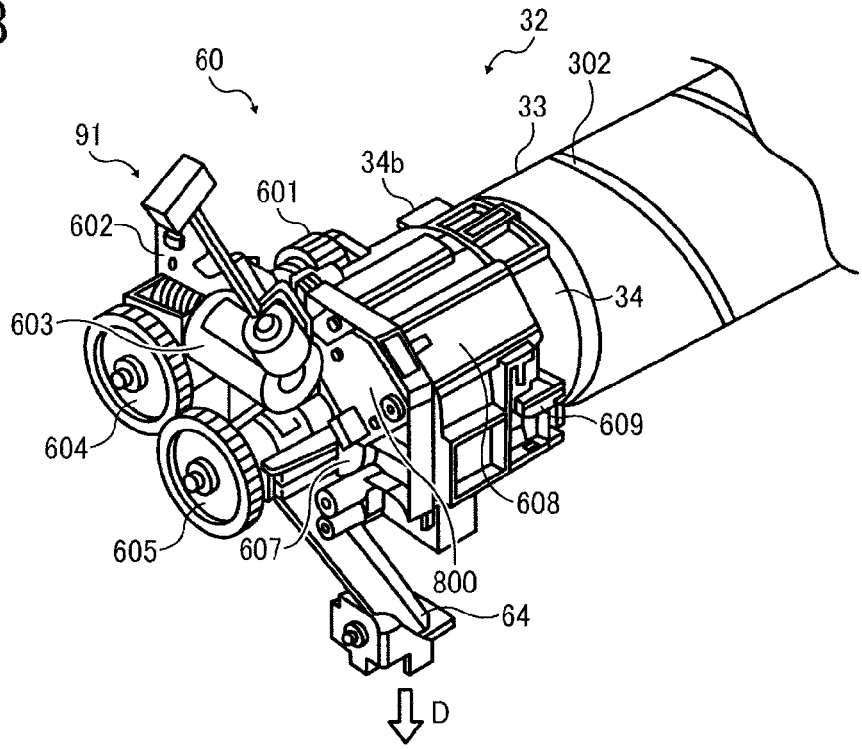
FIG. 8 is an enlarged perspective view of the toner replenishing device and the front end portion of the toner container being attached thereto.
Figure 9:
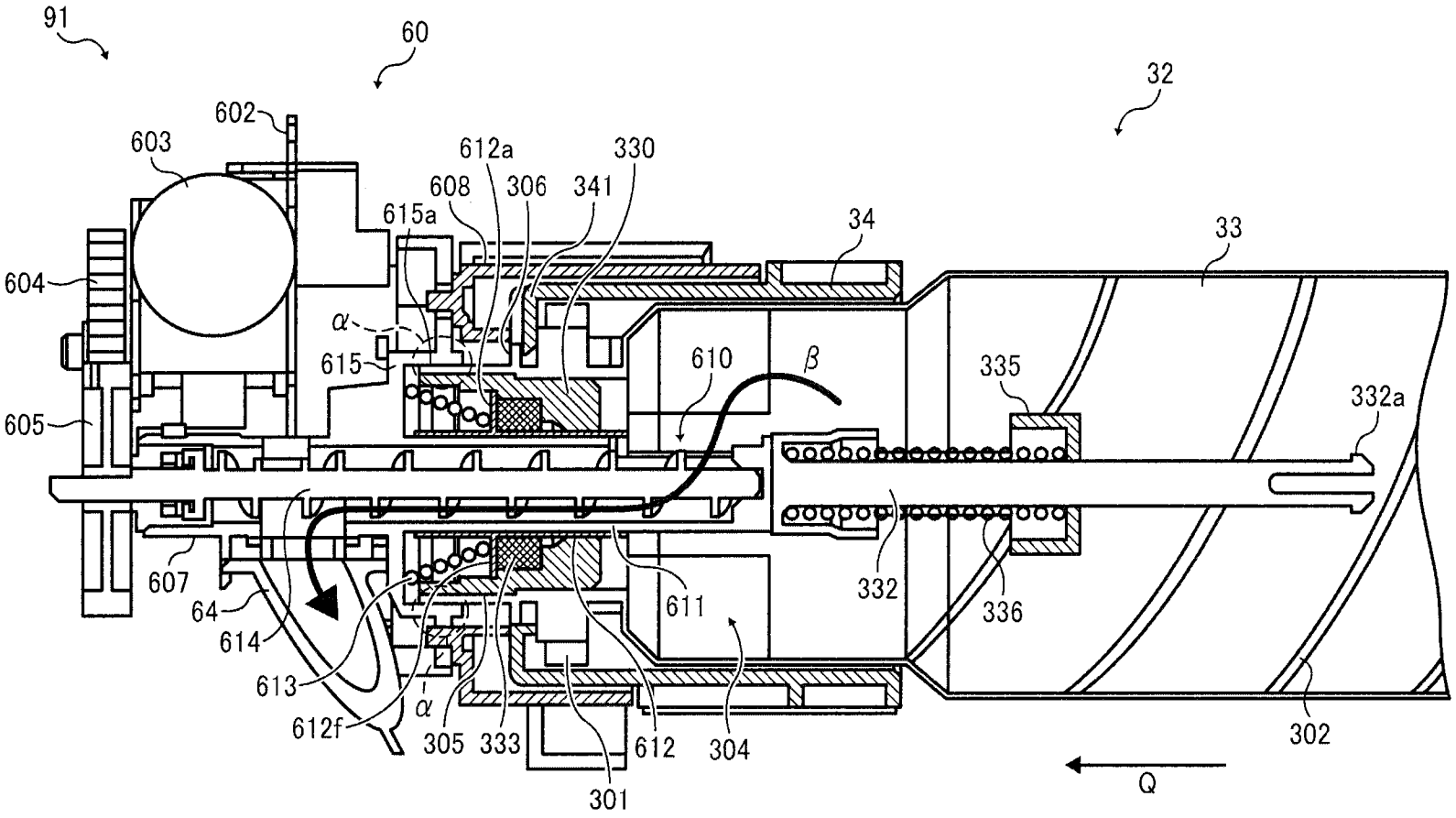
FIG. 9 is a longitudinal sectional view of the toner replenishing device and the front end portion of the toner container being attached thereto.

FIG. 1 is a longitudinal sectional view of the front end portion of the toner container 32 and the toner replenishing device 60 before the toner container 32 is attached thereto. FIG. 6 is a perspective view of the toner container 32 according to the present embodiment. FIG. 7 is an enlarged perspective view of the front end portion of the toner container 32 and the toner replenishing device 60 before the toner container 32 is mounted therein. FIG. 8 is an enlarged perspective view of the toner replenishing device 60 and the front end portion of the toner container 32 attached thereto. FIG. 9 illustrates a longitudinal section of the toner replenishing device 60 and the front end portion of the toner container 32 attached thereto.

The toner replenishing device 60 includes a nozzle shutter 612 in addition to the conveying nozzle 611 provided with the conveying screw 614. The nozzle shutter 612 closes a nozzle opening 610 formed in the conveying nozzle 611 in the state shown in FIGS. 7 and 9, in which the toner container 32 is not connected to the conveying nozzle 611. When the toner container 32 is connected to the conveying nozzle 611, the nozzle shutter 612 opens the nozzle opening 610.

In a center area of the front face of the toner container 32, a nozzle connecting opening 331 for receiving the conveying nozzle 611 is formed, and a container shutter 332 is provided to close the nozzle connecting opening 331 when the conveying nozzle 611 is not connected thereto. The front end portion of the bottle body 33 includes a nozzle receiver 330 and the nozzle connecting opening 331. In the first embodiment, as shown in, for example, FIGS. 9, 12 and 13, the container shutter 332 extends in the axial direction of the bottle body 33, shaped like a plug, and slidable inside the nozzle receiver 330 in the axial direction.

Figure 10:
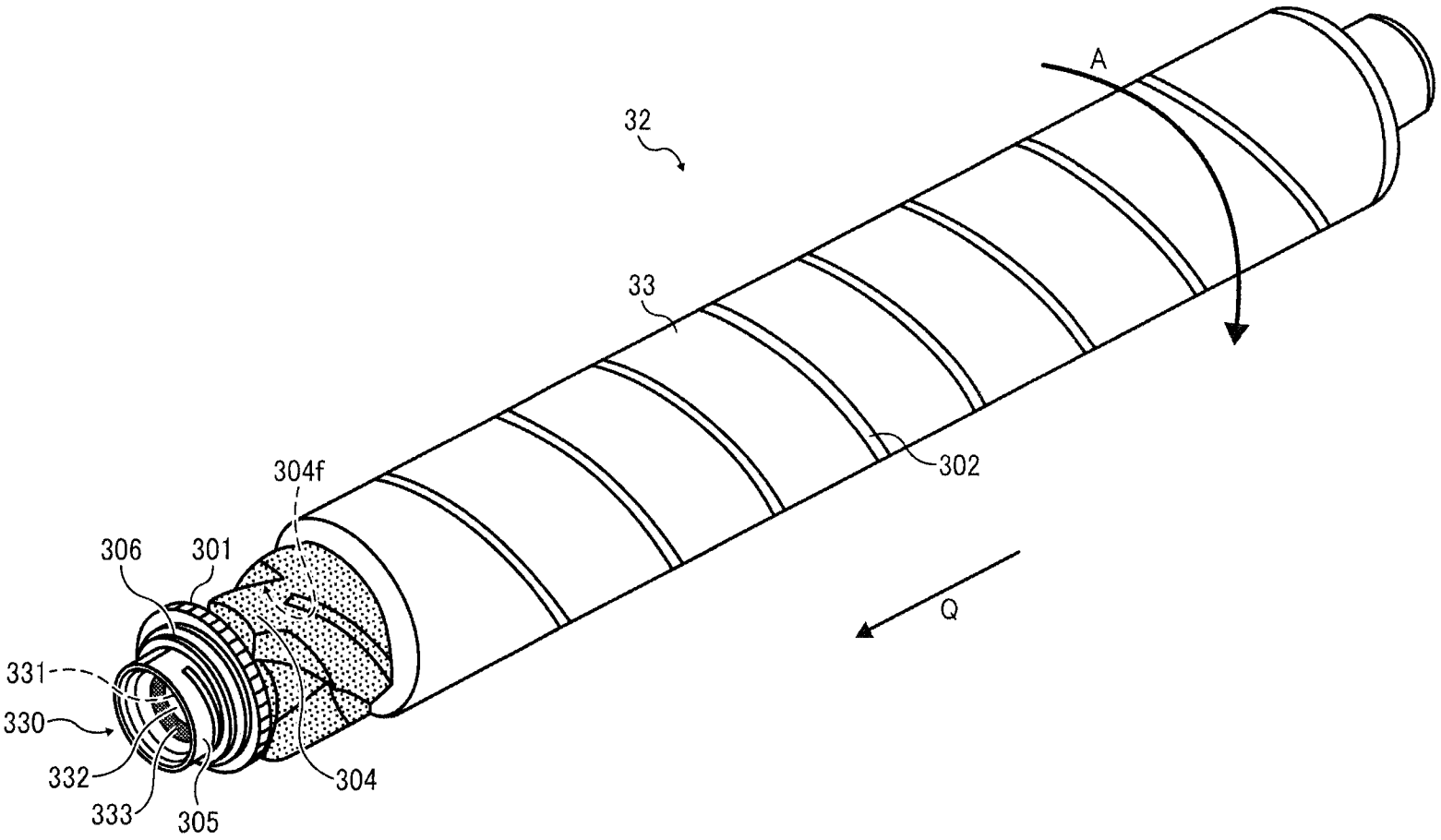
FIG. 10 is a perspective view of a bottle body of the toner container according to the first embodiment.
Figure 11:
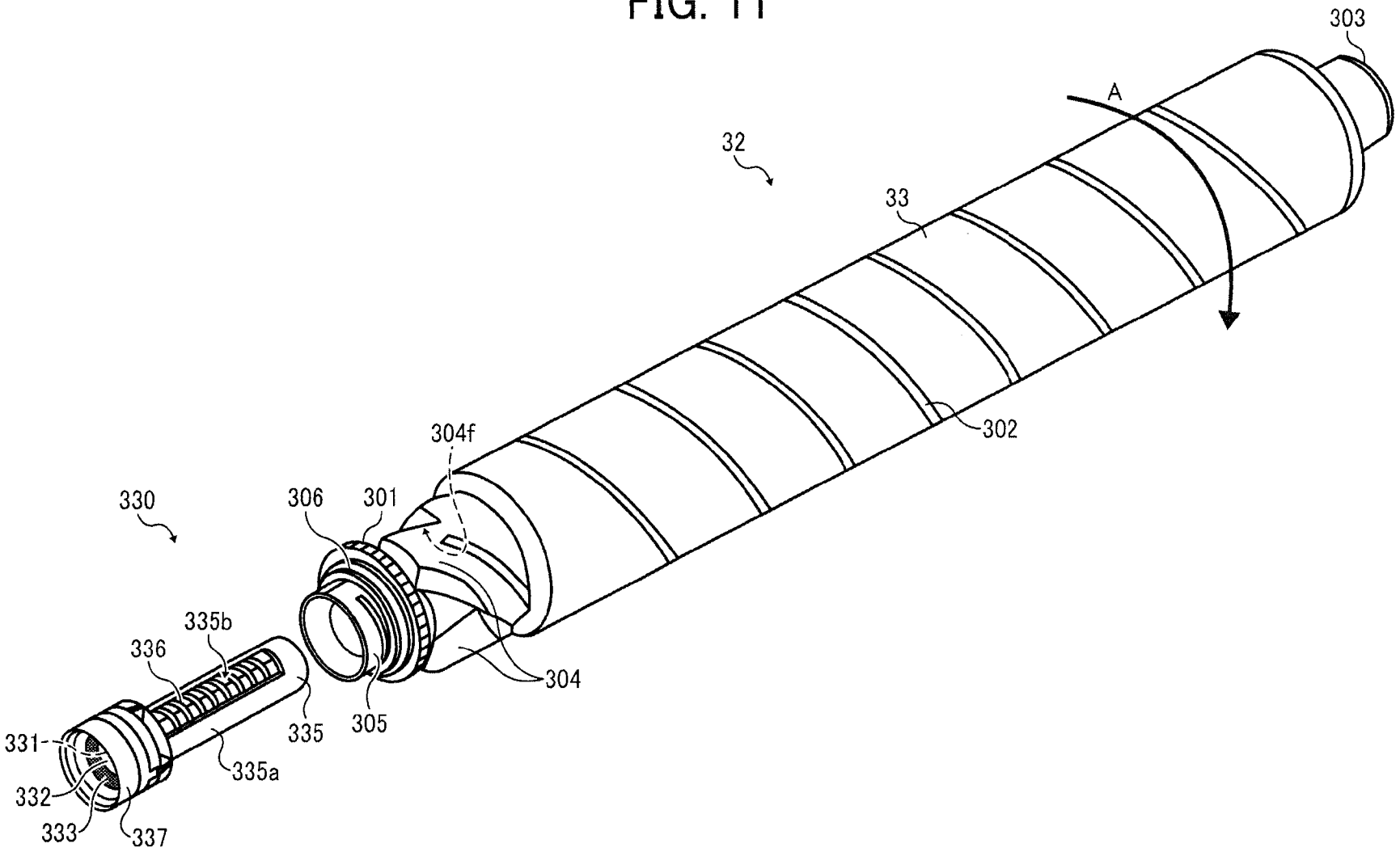
FIG. 11 is an exploded perspective view of the bottle body shown in FIG. 10, from which a nozzle receiver is removed.
Figure 12:
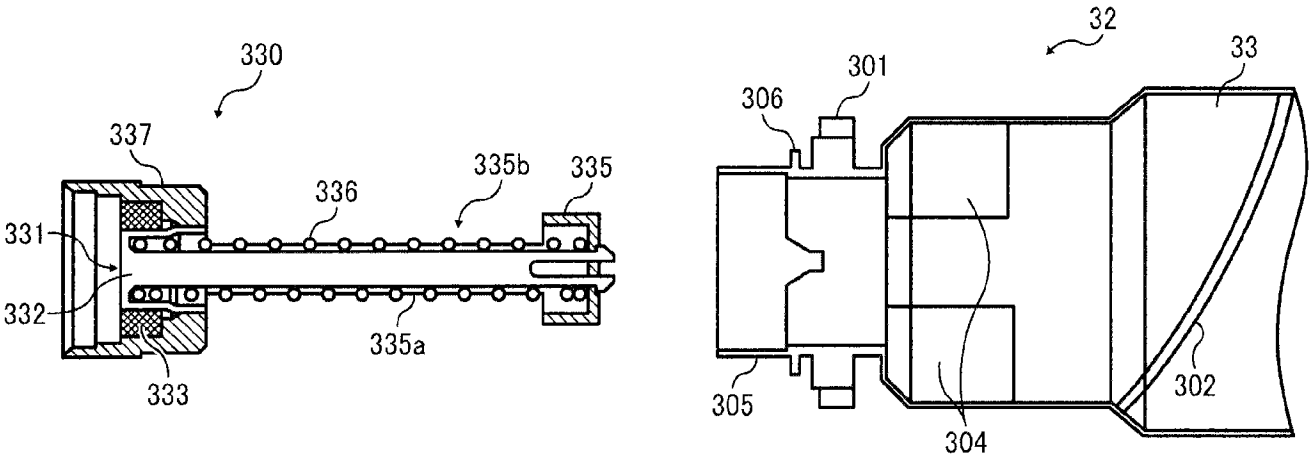
FIG. 12 is a longitudinal sectional view of the bottle body shown in FIG. 11, from which the nozzle receiver is removed.
Figure 13:
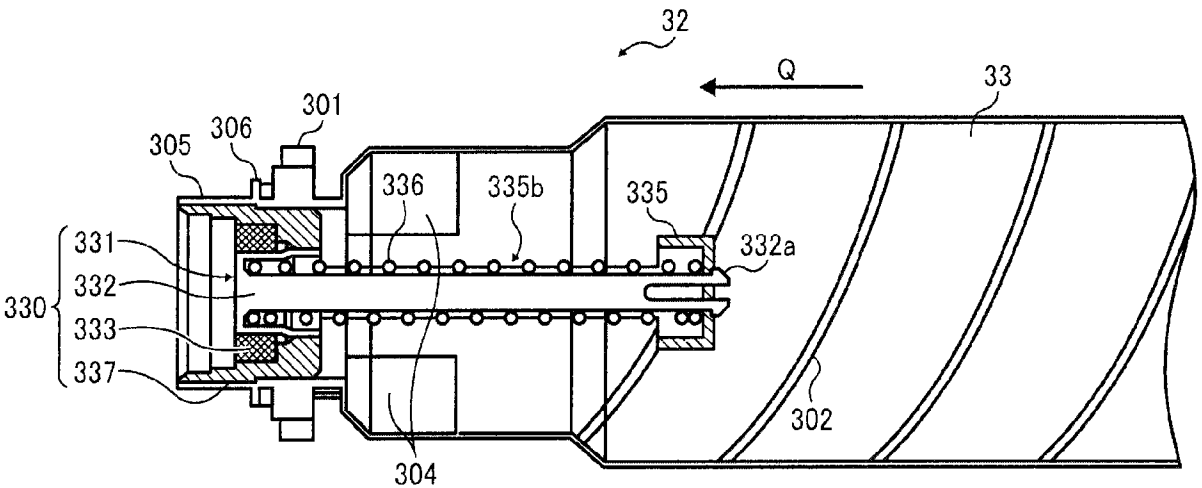
FIG. 13 is a longitudinal sectional view of the bottle body shown in FIG. 12, into which the nozzle receiver is inserted.

FIG. 10 is a perspective view illustrating the bottle body 33 of the toner container 32. It is to be noted that, in FIG. 10, the container front cover 34 is removed from the front end portion of the bottle body 33. FIG. 11 is an exploded perspective view of the bottle body 33 from which the nozzle receiver 330 is removed. FIG. 12 is a longitudinal sectional view of the front end portion of the toner container 32 and the nozzle receiver 330 separated therefrom. FIG. 13 is a longitudinal sectional view of the front end portion of the toner container 32 to which the nozzle receiver 330 is attached.

The bottle body 33 is substantially cylindrical and rotatable around a center axis (i.e., the axis of rotation). It is to be noted that, hereinafter the terms "front" and "anterior" mean the side on which the container front cover 34 is disposed, and the terms "rear" and "posterior" mean the side on which the bottle body 33 is disposed in the direction in which the axis of rotation of the bottle body 33 extends. The longitudinal direction of the toner container 32 parallels the axial direction thereof, and the axial direction is kept horizontal when the toner container 32 is connected to the toner replenishing device 60.

Referring to FIG. 10, the portion of the bottle body 33 posterior to (upstream in the installation direction Q from) the container gear 301 have an external diameter greater than that of the front end portion thereof, and the spiral protrusion 302 is formed on the inner circumferential surface of that portion. As the bottle body 33 rotates in the direction A, toner therein receives conveyance force in the direction from one side to the other side in the axial direction (from the rear side to the front side).

Figure 30:
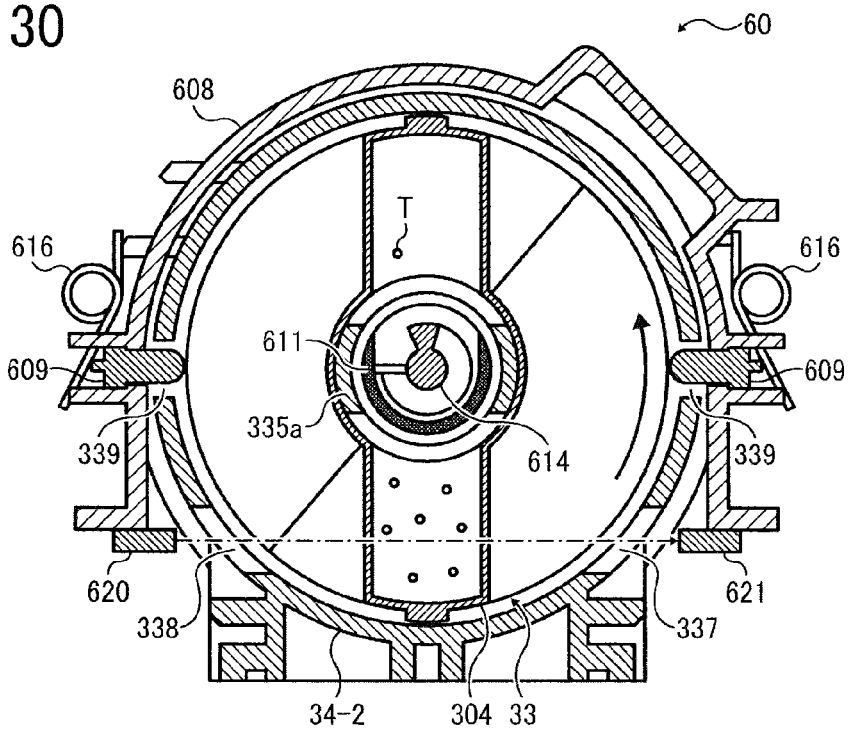
FIG. 30 is a cross sectional view of a container socket of a toner replenishing device and a front end portion of a toner container held therein, according to a second embodiment.

Toner is transported to the front side along the spiral protrusion 302 as the bottle body 33 rotates in the direction A. The front end portion of the bottle body 33 includes a scooping portion 304 serving as a shovel or scoop to scoop up the toner using the rotation of the bottle body 33. An inner surface of the scooping portion 304 projects or extends inward in the bottle body 33 serving as the powder chamber (as shown in FIG. 30).

For example, a portion of the inner wall of the scooping portion 304, on the upstream side in the direction of rotation, is shaped into a paddle blade against the direction of rotation and referred to as "scooping wall surface 304*f*". The shape of the scooping portion 304 is not limited thereto.

When the space inside the scooping portion 304 is positioned on the lower side, using the rotation of the bottle body 33, the scooping wall surface 304*f* scoops up the toner transported to the scooping portion 304 by the conveyance force exerted by the scooping portion 304. Thus, the toner can be brought above the conveying nozzle 611.

The container gear 301 is anterior to the scooping portion 304 in the bottle body 33. The container front cover 34 is party cut away, forming a cutout 34*a* (i.e., a gear exposing cutout), to expose partly the container gear 301 (on the distal side in FIG. 6) in a state in which the container front cover 34 is attached to the bottle body 33. When the toner container 32 is connected to the toner replenishing device 60, the container gear 301 exposed through the cutout 34*a* meshes with a container driving gear 601 (shown in FIGS. 7 and 8) on the side of the toner replenishing device 60.

A cylindrical front opening section 305 (i.e., a front opening forming section) is positioned anterior to the container gear 301 in the bottle body 33. A fixing portion 337 of the nozzle receiver 330 is fitted in the front opening section 305 (press fit), and thus the nozzle receiver 330 can be fixed to the bottle body 33. The fixing method is not limited to press fit. Alternatively, the nozzle receiver 330 may be glued or screwed to the bottle body 33, for example.

After the bottle body 33 is filled with toner through the opening inside the front opening section 305, the nozzle receiver 330 is fixed to the front opening section 305 of the bottle body 33.

A cover catch 306 (shown in FIGS. 9 through 12) projects from an outer circumferential surface at an end of the front opening section 305 on the side of the container gear 301. To the toner container 32 (the bottle body 33 in particular) being in the state shown in FIG. 10, the container front cover 34 is attached from the front side (on the left in FIG. 10). Then, the bottle body 33 penetrates the container front cover 34 in the axial direction. Then, a cover hook 341 provided in an upper portion of the container front cover 34 is hooked to the cover catch 306. The cover catch 306 extends over the entire circumference of the front opening section 305. With the cover hook 341 retained by the cover catch 306, the bottle body 33 can rotate relative to the container front cover 34. Although the cover catch 306 is continuous over the entire circumference in the configuration shown in the drawings, alternatively, the cover catch 306 may be divided and disposed at multiple positioned at intervals. For example, three cover catches 306 may be formed at 120 degrees apart.

The bottle body 33 can be formed by using biaxial stretch blow molding, for example. Typically, biaxial stretch blow molding includes two steps, namely, preform molding and stretch blow molding. In the preform molding step, resin is injected into a mold shaped like a test tube, thus forming a tube-shaped preform. During the step of injection molding, the front opening section 305, the cover catch 306, and the container gear 301 are formed at the opening of the tube-shaped preform. Subsequently, the preform is cooled, removed from the mold, and heated. Then, blow molding and stretch of the softened preform are executed as the step of stretch blow molding.

The portion of the bottle body 33 posterior to the container gear 301 can be formed in the step of stretch blow molding. That is, the handle 303 and the portion where the scooping portion 304 and the spiral protrusion 302 are positioned are formed by stretch blow molding.

The shapes of the elements, such as the container gear 301, the front opening section 305, and the cover catch 306, positioned anterior to the container gear 301 are not changed from the preform. Accordingly, dimensional accuracy can be high. By contrast, elements produced by stretch blow molding, such the handle 303, the scooping portion 304, and the spiral protrusion 302, may have a lower degree of dimensional accuracy than that of the front portions.

Next, the nozzle receiver 330 fixed to the bottle body 33 is described below.

Figure 14:
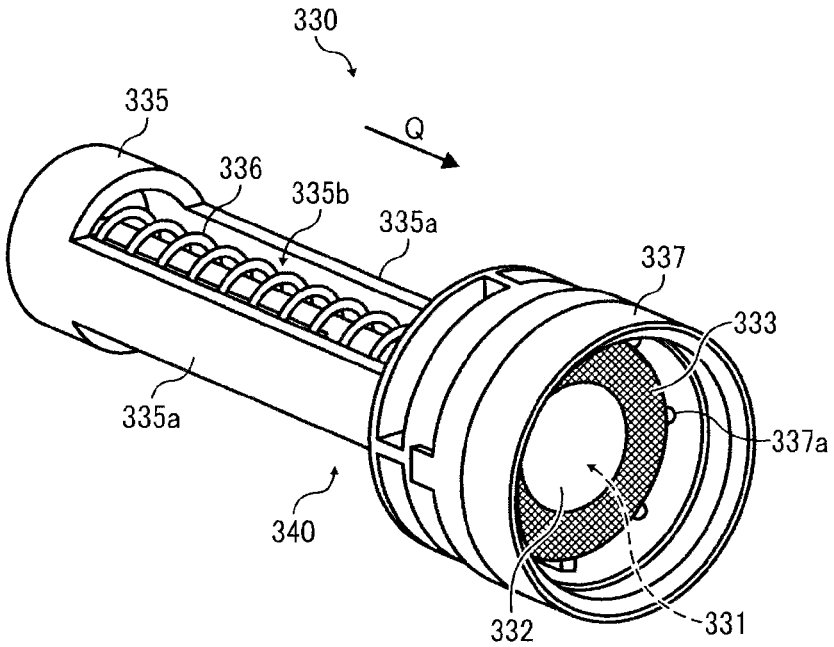
FIG. 14 is a perspective view illustrating the nozzle receiver from a front side of the toner container.
Figure 15:
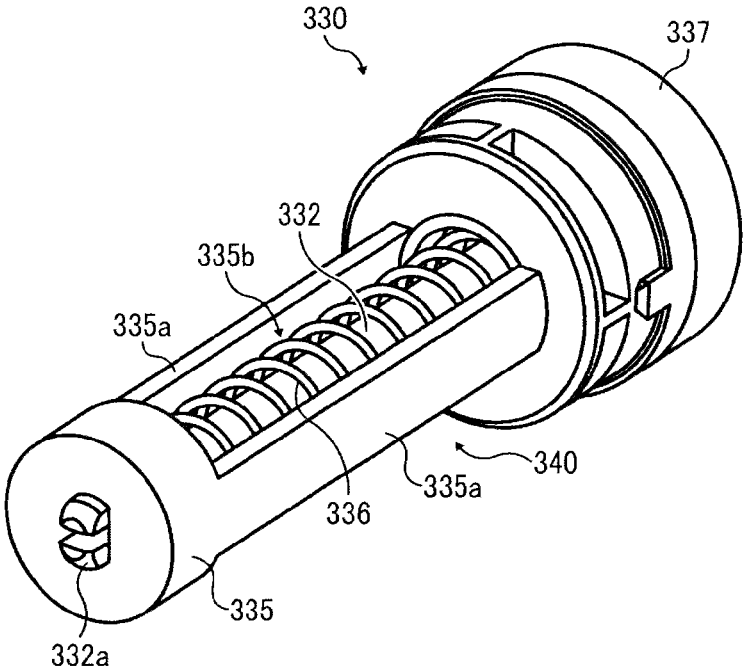
FIG. 15 is a perspective view illustrating the nozzle receiver from a rear side of the toner container.

FIG. 14 is a perspective view illustrating the nozzle receiver 330 from the front side. FIG. 15 is a perspective view illustrating the nozzle receiver 330 from the rear side.

The nozzle receiver 330 includes the container shutter 332 and a shutter supporter 340. The shutter supporter 340 includes a rear end support 335, two shutter side supports 335*a*, and the fixing portion 337. The two shutter side supports 335*a* together from a part of a cylinder from which a large space between the shutter side supports 335*a* is cut away, thus forming an opening 335*b* between the shutter side supports 335*a*. The opening 335*b* communicates with the nozzle opening 610. With this configuration, the container shutter 332 can be guided to move inside a cylindrical space defined inside the shutter side supports 335*a* in the axial direction. The nozzle receiver 330 further includes a container seal 333 and a shutter spring 336 that can be a coil spring.

Figure 16:
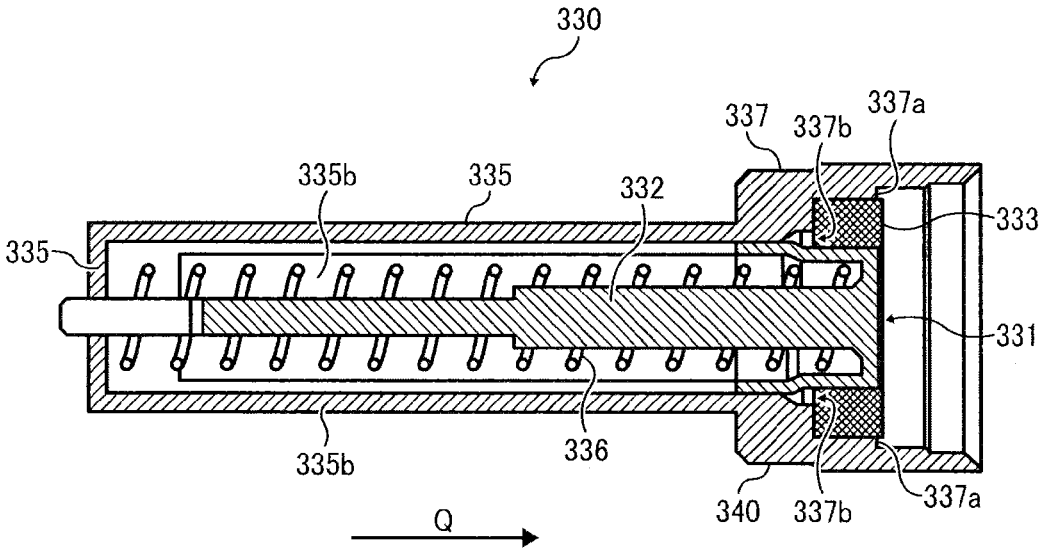
FIG. 16 is a longitudinal sectional view of the nozzle receiver being cut at the position of shutter side supports.
Figure 17:
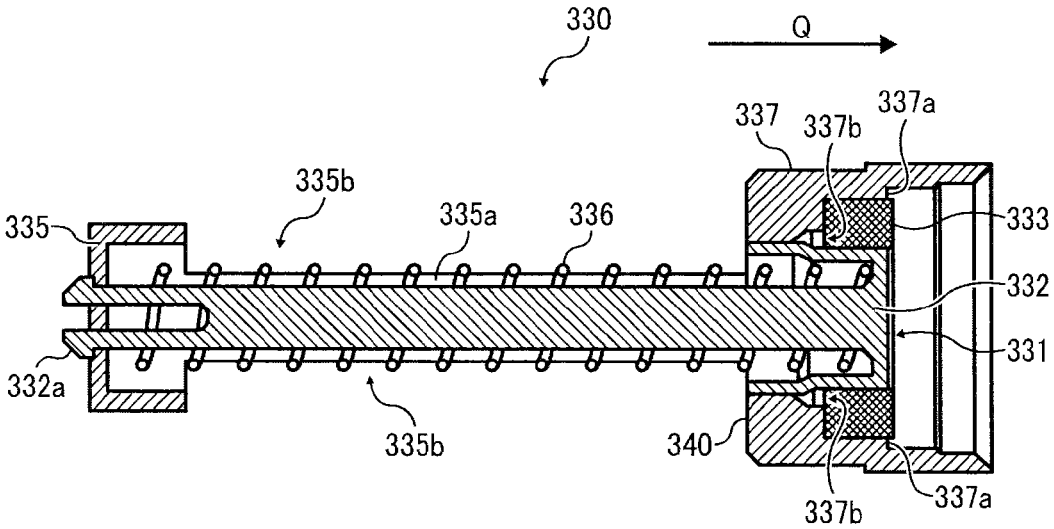
FIG. 17 is a longitudinal sectional view of the nozzle receiver being cut at the position of an opening between the shutter supporters.
Figure 18:
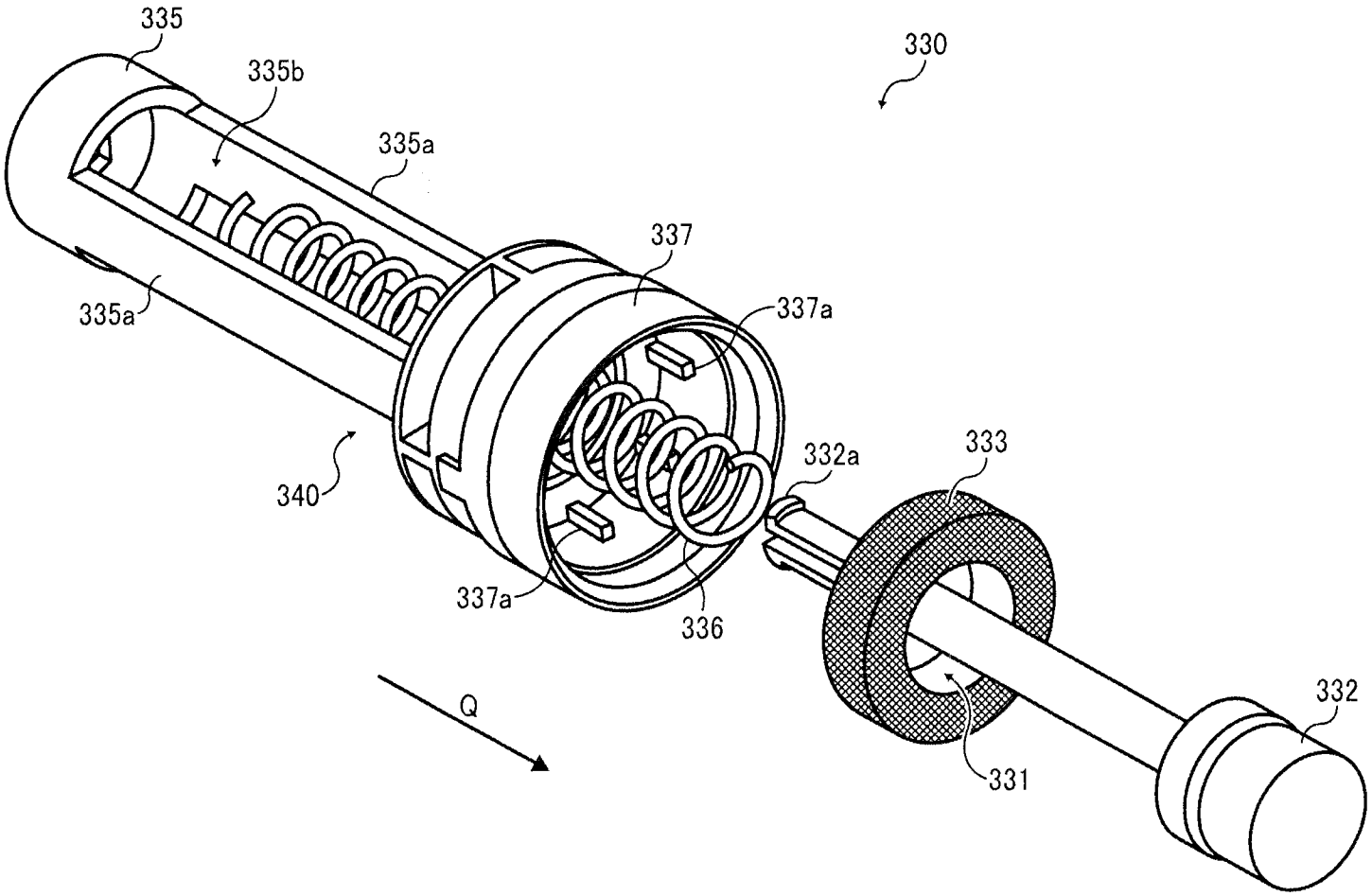
FIG. 18 is an exploded perspective view of the nozzle receiver from which a container shutter is removed.

FIG. 16 is a longitudinal sectional view of the nozzle receiver 330 being cut at the position of the shutter side supports 335*a*. FIG. 17 is a longitudinal sectional view of the nozzle receiver 330 being cut at the position of the opening 335*b*. FIG. 18 is an exploded perspective view of the nozzle receiver 330 from which the container shutter 332 is pulled out.

As shown in FIGS. 16 and 17, a front end of the shutter spring 336 contacts a wall face of the container shutter 332, and a rear end oaf the shutter spring 336 contacts a wall face of the rear end support 335. At that time, since the shutter spring 336 is compressed, the container shutter 332 is urged away from the rear end support 335 (to the right in FIGS. 16 and 17) downstream in the installation direction Q) to the front end.

A pair of hooks 332*a* is formed at the rear end of the container shutter 332 to be hooked on an outer wall of the rear end support 335. With the hooks 332*a*, the container shutter 332 can be prevented from moving further away from the rear end support 335 from the position shown in FIGS. 16 and 17. The position of the container shutter 332 can be determined relative to the container shutter 332 by the engagement between the hooks 332*a* and the rear end support 335 as well as the bias force exerted by the shutter spring 336.

The fixing portion 337 is shaped like a stepped cylinder with its inner diameter decreasing to the rear end. As shown in FIG. 16, the container seal 333 that is toroidal is disposed in a portion where the diameter of the cylindrical space between the two shutter side supports 335*a* equals to the inner diameter of the fixing portion 337 (on which the outer face of the container shutter 332 slides) so that the container seal 333 contacts the step on the front side. The container seal 333 can be fixed to the step of the fixing portion 337 using glue or double-sided adhesive tape.

As shown in FIGS. 16 and 17, in the fixing portion 337 of the nozzle receiver 330, a seal jam preventing space 337*b* is provided at an innermost position of the step that contacts the container seal 333. The seal jam preventing space 337*b* is cylindrical and have a diameter smaller than the external diameter of the toroidal container seal 333 and greater than the diameter of the inner circumferential surface on which the outer circumferential surface of the container shutter 332 slides.

When the container shutter 332 moves to the rear side from the position (shown in FIGS. 16 and 17) closing the nozzle connecting opening 331, an inner circumferential portion of the toroidal container seal 333 slides on the container shutter 332. Accordingly, the inner circumferential portion of the container seal 333 deforms elastically toward the rear side, being pulled by the container shutter 332. If the stepped portion of the fixing portion 337, with which the container seal 333 contacts, is continuous with the inner circumferential surface that slidingly contacts the outer circumferential surface of the container shutter 332, there can be a risk that the deformed portion of the container seal 333 is sandwiched between the outer circumferential surface of the container shutter 332 and the inner circumferential surface of the fixing portion 337 that slidingly contacts the container shutter 332. If the container seal 333 is entangled in the portion where the fixing portion 337 slidingly contacts with the container shutter 332, the container shutter 332 is locked relative to the fixing portion 337, and opening and closing of the nozzle connecting opening 331 are hindered.

In view of the foregoing, in the toner container 32 according to the present embodiment, the nozzle receiver 330 includes the seal jam preventing space 337*b* on the inner circumferential side thereof. Since the seal jam preventing space 337*b* has an external diameter smaller than the external diameter of the toroidal container seal 333, the container seal 333 does not enter the seal jam preventing space 337*b* as a whole. Even if the portion of the container seal 333 pulled by the container shutter 332 and deformed elastically moves to the rear side and enters the seal jam preventing space 337*b*, the container seal 333 can be prevented from being entangled in the portion where the fixing portion 337 slidingly contacts the container shutter 332 because the diameter of the seal jam preventing space 337*b* is greater than the inner circumferential surface that slidingly contacts the outer circumferential surface of the container shutter 332. Accordingly, the container seal 333 can be prevented from being entangled in the portion where the fixing portion 337 slidingly contacts with the container shutter 332, and the container shutter 332 can be prevented from being locked relative to the fixing portion 337. Thus, opening and closing of the nozzle connecting opening 331 can be secured.

As shown in FIGS. 16 through 18, on the inner circumferential surface of the fixing portion 337, multiple ribs 337*a* (i.e., nozzle shutter positioning ribs) are formed in the area where the container seal 333 is provided. Referring to FIGS. 16 and 17, when the container seal 333 is fixed to the fixing portion 337, a front end face (on the right in FIGS. 16 and 17) of the container seal 333 is projects beyond a front end of the rib 337*a* in the axial direction. As shown in FIG. 9, the nozzle shutter 612 of the toner replenishing device 60 includes a nozzle shutter flange 612*a*, and a front face (left side in FIG. 9) of the nozzle shutter flange 612*a* receives a nozzle shutter spring 613 (hereinafter "spring receiving surface 612*f*").

Referring to FIG. 9, when the toner container 32 is connected to the toner replenishing device 60, the nozzle shutter flange 612*a* of the nozzle shutter 612 comes into contact with the front ends of the ribs 337*a*. Then, the nozzle shutter flange 612*a* contacts the front end portion of the container seal 333 projecting beyond the ribs 337*a*, presses or squeezes the container seal 333, and then contacts the ribs 337*a*. Thus, at the time of installation, sealing around the conveying nozzle 611 in the nozzle connecting opening 331 can be secured, preventing toner leak, since the container seal 333 is squeezed by the nozzle shutter flange 612*a*.

In the toner container 32, the elastic container seal 333 forms a front end face of the nozzle receiver 330 in which the nozzle connecting opening 331 (to which the conveying nozzle 611 is inserted) is formed. Then, the nozzle shutter flange 612*a* (i.e., a contact portion) of the nozzle shutter 612 (i.e., powder inlet opening and closing member) presses against the front end face, compressing the container seal 333. With this operation, the surface of the nozzle shutter flange 612*a* opposite the spring receiving surface 612*f* closely contacts the container seal 333, thus enhancing toner leak prevention.

In the fixing portion 337 of the nozzle receiver 330, when the container seal 333, the elastic member, is squeezed, the nozzle shutter flange 612*a* (shown in FIG. 9) comes into contact with the multiple ribs 337*a*. As the rear side (opposite the spring receiving surface 6120 of the nozzle shutter flange 612*a* contacts the ribs 337*a*, the nozzle shutter 612 is set in position relative to the toner container 32 in the axial direction. Thus, the relative positions between the front end face of the container seal 333, the front end face of the front opening section 305, and the nozzle shutter 612 in the axial direction are determined.

In installation of the toner container 32, after the nozzle shutter flange 612*a* contacts the ribs 337*a* and determines the position of the nozzle shutter 612 relative to the toner container 32, opening of the nozzle opening 610 is started. By contrast, in removal of the toner container 32 from the toner replenishing device 60, the position of the nozzle shutter 612 relative to the toner container 32 does not change while the nozzle opening 610 is open, even if the conveying nozzle 611 is moved in the direction of removal from the toner container 32. The nozzle shutter 612 is pulled out from the toner container 32 together with the conveying nozzle 611 after the nozzle shutter 612 closes the nozzle opening 610. While the nozzle shutter flange 612*a* is in contact with the ribs 337*a*, the portion of the conveying nozzle 611 in which the nozzle opening 610 is formed is positioned substantially inside the toner container 32 (upstream in the installation direction Q) from the entrance of the nozzle connecting opening 331. Since opening or closing of the nozzle opening 610 is started when the nozzle opening 610 is inside the toner container 32, toner leak from the nozzle opening 610 can be prevented.

The nozzle receiver 330 fixed to the bottle body 33 rotates as the bottle body 33 rotates. At that time, the shutter side supports 335*a* of the nozzle receiver 330 rotate around the conveying nozzle 611 of the toner replenishing device 60. Accordingly, when the rotating shutter side support 335*a* is present above the nozzle opening 610 formed in the upper portion of the conveying nozzle 611, the rotating shutter side support 335*a* hinders supply of toner from the bottle body 33 to the conveying nozzle 611. By contrast, when the two shutter side supports 335*a* are positioned on the lateral sides of the conveying nozzle 611 and the nozzle opening 610 formed in the conveying nozzle 611 faces the opening 335*b* formed in the shutter supporter 340, toner can be supplied from the bottle body 33 to the conveying nozzle 611 as indicated by arrow 13 shown in FIG. 9.

In the nozzle receiver 330 shown in FIGS. 16 and 17, a rear portion of the fixing portion 337 is reduced in external diameter from the front portion of the fixing portion 337. Thus, a step is formed on the outer circumferential surface of the fixing portion 337 in midway in the axial length thereof. Additionally, as shown in FIG. 13, the front opening section 305 of the bottle body 33 has an inner circumferential surface conforming to the shape of the outer circumferential surface of the fixing portion 337. Thus, a rear portion of the front opening section 305 is reduced in inner diameter, thus forming a step. This configuration can inhibit deviation of axis of the nozzle receiver 330 relative to the bottle body 33 as the step on the outer circumferential surface of the fixing portion 337 contacts the step on the inner circumferential surface of the front opening section 305 over the entire circumference. The term "deviation of axis" used here means that the center axis of the cylindrical fixing portion 337 is inclined from the center axis of the cylindrical front opening section 305.

As shown in FIG. 7, the toner replenishing device 60 further includes the container socket 608 including container locks (lock levers) 609 serving as retainers, and container engagement portions 339 are formed in the container front cover 34. The engagement portions 339 include holes for the container locks 609 to penetrate the container front cover 34 from outside. Additionally, an identification (ID) tag 700 is provided to the container front cover 34 for recording data relating to the toner container 32 such as usage conditions. Reference numeral 800 shown in FIGS. 7 and 8 represents a connector for the ID tag 700. The container front cover 34 further includes color discrimination ribs 34*b* to prevent the toner container 32 of the wrong color from being mounted to the container socket 608.

Next, a configuration of the toner replenishing devices 60 is described below in further detail.

As shown in FIGS. 7 and 8, the toner replenishing device 60 includes a nozzle holder 607 to fix the conveying nozzle 611 to a frame 602 of the apparatus body 100 of the image forming apparatus 500. The container socket 608 is fixed to the nozzle holder 607. The vertical toner tube 64 is fixed to the nozzle holder 607 and communicates with the interior of the conveying nozzle 611 from below.

The driving section 91 is fixed to the frame 602. The driving section 91 includes a driving motor 603, the container driving gear 601, and a worm gear 603*a* to transmit rotation of the driving motor 603 to a rotary shaft of the container driving gear 601. A drive transmission gear 604 is fixed to the rotary shaft of the container driving gear 601 to engage the screw gear 605 fixed to the rotary shaft of the conveying screw 614. In this configuration, rotation of the driving motor 603 is transmitted via the container driving gear 601 and the container gear 301 to the toner container 32, thereby rotating the toner container 32. The driving motor 603 further rotates the conveying screw 614 via the drive transmission gear 604 and the screw gear 605.

Alternatively, a clutch may be provided in a drive transmission route from the driving motor 603 to the container gear 301 or a drive transmission route from the driving motor 603 to the screw gear 605. When such a clutch is provided, only one of the toner container 32 and the conveying screw 614 can be driven as the driving motor 603 rotates.

Next, installation of the toner container 32 to the toner replenishing device 60 is described below.

Referring to FIG. 1, when the toner container 32 is moved toward the toner replenishing device 60 (in the installation direction Q shown in, for example, FIGS. 1 and 7), an end 611*a* of the conveying nozzle 611 contacts a front end face of the container shutter 332. It is to be noted that the end 611*a* is on the opening side, whereas the opposite side of the conveying nozzle 611 is referred to as "base side". When the toner container 32 is moved further toward the toner replenishing device 60, the conveying nozzle 611 presses against the front end face of the container shutter 332. Then, as the shutter spring 336 is compressed, the container shutter 332 is pushed inside the toner container 32 (to the rear side of the toner container 32, and the end 611*a* of the conveying nozzle 611 is inserted into the nozzle connecting opening 331. At that time, a nozzle shutter tube 612*e* anterior to (upstream in the installation direction Q from) the nozzle shutter flange 612*a* is inserted into the nozzle connecting opening 331 together with the conveying nozzle 611.

As the toner container 32 moves further to the toner replenishing device 60, the rear side of the nozzle shutter flange 612*a*, opposite the spring receiving surface 612*f*, contacts and presses the front end face of the container seal 333. Accordingly, the rear side of the nozzle shutter flange 612*a* contacts the ribs 337*a*, and the nozzle shutter 612 is set in position relative to the toner container 32 in the axial direction.

As the toner container 32 moves further to the toner replenishing device 60, the conveying nozzle 611 is inserted further into the toner container 32. At that time, the nozzle shutter 612 being in contact with the ribs 337*a* is pushed back, relative to the conveying nozzle 611, to the base side of the conveying nozzle 611 (downstream side in the installation direction Q). With this movement, the nozzle shutter spring 613 is compressed, and the nozzle shutter 612 moves to the base side of the conveying nozzle 611 relative to the conveying nozzle 611. With this relative movement, the nozzle opening 610 is released from the nozzle shutter 612 and exposed inside the bottle body 33. Thus, the conveying nozzle 611 communicates with the interior of the bottle body 33.

When the conveying nozzle 611 is retained in the nozzle connecting opening 331, the shutter spring 336 and the nozzle shutter spring 613, which are compressed, exert force to push back the toner container 32 relative to the toner replenishing device 60 (in the direction reverse to the installation direction Q). However, when the toner container 32 is inserted to the toner replenishing device 60, the toner container 32 is moved in the installation direction Q, against the force exerted by the shutter spring 336 and the nozzle shutter spring 613, to the position where the container engagement portion 339 receives the container lock 609 of the container socket 608 of the toner replenishing device 60. Then, the axial position of the toner container 32 relative to the toner replenishing device 60 is determined in the state shown in FIGS. 8 and 9 by the force exerted by the shutter spring 336 and the nozzle shutter spring 613 as well as engagement between the container locks 609 and the container engagement portions 339.

As shown in FIG. 7, the container engagement portions 339 are formed in both lateral side faces of the container front cover 34. On a virtual plane perpendicular to the axial direction of the toner container 32, the container shutter 332 is positioned at a center of a segment connecting together the two container engagement portions 339. If the container shutter 332 is not positioned on the segment connecting the two container engagement portions 339, rotation moment (torque) can be caused. That is, rotational moment to rotate the toner container 32 around the segment is caused by the force exerted at the position of the container shutter 332 by the shutter spring 336 and the nozzle shutter spring 613. It is possible that the rotational moment can tilt the toner container 32 relative to the toner replenishing device 60. Therefore, in the toner container 32 according to the present embodiment, the container shutter 332 is positioned on the segment connecting together the two container engagement portions 339. This configuration can protect the toner container 32 from tilting relative to the toner replenishing device 60 due to the bias force exerted at the position of the container shutter 332 by the shutter spring 336 and the nozzle shutter spring 613.

It is to be noted that, in a state in which the toner container 32 is connected to the toner replenishing device 60, the end face of the cylindrical front opening section 305, which is the end face of the toner container 32, does not contact the end face of a container setting section 615, which is a part of the container socket 608 and can be disposed, for example, on the bottom of the container socket 608. The container socket 608 and the container setting section 615 are used for positioning the toner container 32.

The toner container 32 is inhibited from moving further in the installation direction Q if the end face of the cylindrical front opening section 305 contacts the end face of the container setting section 615 before the container locks 609 enter the container engagement portions 339. Accordingly, positioning of the toner container 32 in the axial direction is hindered. Therefore, in a state in which the toner container 32 is connected to the toner replenishing device 60, clearance is secured between the end face of the cylindrical front opening section 305 and the end face of the container setting section 615.

With the toner container 32 positioned in the axial direction, the outer circumferential surface of the front opening section 305 slidingly contacts an inner circumferential surface 615*a* of the container setting section 615. Accordingly, the position of the toner container 32 relative to the toner replenishing device 60 can be determined in a direction along a plane perpendicular to the axial direction of the toner container 32. Thus, installation of the toner container 32 to the toner replenishing device 60 is completed.

After the toner container 32 is installed, the driving motor 603 is rotated, thereby rotating the bottle body 33 and the conveying screw 614 in the conveying nozzle 611. As the bottle body 33 rotates, toner therein is transported by the spiral protrusion 302 to the front side. When the toner reaches the scooping portion 304, the scooping portion 304 lifts the toner above the nozzle opening 610 as the bottle body 33 rotates, and toner falls to the nozzle opening 610. Then, the toner is supplied into the conveying nozzle 611. The toner is transported inside the conveying nozzle 611 by the conveying screw 614 and supplied to the developing device 50 through the vertical toner tube 64. It is to be noted the flow of toner from the bottle body 33 to the vertical toner tube 64 is indicated by arrow 13 shown in FIG. 9.

Reference character a shown in FIG. 9 represents the position where the front opening section 305 slidingly contacts the inner circumferential surface 615*a* of the container setting section 615 and the position of the toner container 32 relative to the toner replenishing device 60 is determined. It is to be noted that, although this position have both capabilities of sliding contact and positioning, alternatively, this position can have either of them.

The nozzle receiver 330 of the toner container 32 includes the nozzle connecting opening 331, the opening 335*b*, and the container shutter 332. The nozzle connecting opening 331 provided in the front end portion of the bottle body 33 receives the conveying nozzle 611 in which the nozzle opening 610, serving as a powder inlet, is formed. The opening 335*b* positioned between the shutter side supports 335*a* serves as a supply inlet to supply toner contained in the bottle body 33 to the nozzle opening 610. As the conveying nozzle 611 is inserted into and pulled out from the nozzle receiver 330, the container shutter 332 supported by the nozzle receiver 330 slides in the axial direction and opens and closes the nozzle connecting opening 331. With this configuration, in the toner container 32, the nozzle connecting opening 331 is kept closed until the conveying nozzle 611 is inserted thereto. Thus, before the toner container 32 is connected to the toner replenishing device 60, leak and scattering of toner can be prevented.

When the conveying nozzle 611 is inserted into the nozzle connecting opening 331, the container shutter 332 slides to the rear side, pushed by the conveying nozzle 611. Then, toner accumulating around the opening 335*b* is pushed away. Thus, space for the portion of the conveying nozzle 611 including the nozzle opening 610 can be secured around the opening 335*b*, and toner can be supplied reliably from the opening 335*b* to the nozzle opening 610. Thus, leak or scattering of toner from the toner container 32 being removed from the toner replenishing device 60 can be prevented, while discharge of toner from the toner container 32 (bottle body 33) being connected to the toner replenishing device 60 can be secured.

Referring to FIGS. 1 and 9, when the nozzle opening 610 or the nozzle connecting opening 331 is open, it is possible that toner scatters therefrom. Therefore, the front end of the container setting section 615 of the toner replenishing device 60 and the front end of the front opening section 305 of the toner container 32 are away from the those openings regardless of whether the toner container 32 is connected to the toner replenishing device 60 or separated therefrom. This configuration can inhibit leak of toner from the nozzle connecting opening 331 before the toner container 32 is connected to the toner replenishing device 60 and from the contact portion between the container seal 333 and the conveying nozzle 611 after the toner container 32 is connected to the toner replenishing device 60. Additionally, during installation and removal of the toner container 32, the container setting section 615 is away from the nozzle opening 610. The front end of the front opening section 305 of the toner container 32 is away from the container shutter 332.

The container shutter 332 to seal the nozzle connecting opening 331, through which toner is discharged from the toner container 32, is positioned posterior to the front end of the front opening section 305 of the bottle body 33. Thus, a certain distance is secured from the container shutter 332 to the front end of the front opening section 305. In this configuration, to go out the bottle body 33, toner is to travel a distance from the nozzle connecting opening 331 posterior to the opening end (i.e., the front end of the front opening section 305) of the bottle body 33. Thus, toner is inhibited from reaching the outer circumferential surface of the front opening section 305, thereby inhibiting scattering of toner.

The position of the toner container 32 relative to the toner replenishing device 60 in the direction perpendicular to the axial direction can be determined by engagement between the outer circumferential surface of the front opening section 305 and the inner circumferential surface of the cylindrical container setting section 615. That is, the outer circumferential surface of the front opening section 305 of the bottle body 33 (i.e., a powder chamber) serves as the positioning portion relative to the toner replenishing device 60 serving as a powder conveyance device. Therefore, toner adhering to the outer circumferential surface of the front opening section 305 can change contact state with the inner circumferential surface 615*a* of the container setting section 615, thus degrading positioning accuracy.

In view of the foregoing, the toner container 32 according to the present embodiment is designed to inhibit toner from reaching and adhering to the outer circumferential surface of the front opening section 305, thereby preventing fluctuations in the positioning accuracy of the toner container 32 relative to the toner replenishing device 60.

When the toner container 32 rotates, the outer circumferential surface of the front opening section 305 and the inner circumferential surface 615*a* of the container setting section 615 slide on each other. Hereinafter the outer circumferential surface of the front opening section 305 of the bottle body 33 is referred to as a sliding portion that slidingly contacts with the toner replenishing device 60, serving as the powder conveyance device. If toner enters the sliding portion, it is possible that sliding load increases, thus increasing rotation torque of the toner container 32.

By contrast, the toner container 32 according to the present embodiment can inhibit toner from reaching the outer circumferential side of the front opening section 305 and inhibit toner from entering the sliding portion with the inner circumferential surface 615*a* of the container setting section 615. Accordingly, increases in sliding load can be reduced, stabilizing sliding, and increases in rotation torque can be reduced. Additionally, with toner inhibited from entering the sliding portion, coagulation of toner in the sliding portion can be inhibited.

When the toner container 32 is connected to the toner replenishing device 60, the nozzle shutter flange 612*a* squeezes the container seal 333 and coheres the container seal 333 with pressure, securing prevention of toner leak. Disposing the container shutter 332 posterior to (inner side in the longitudinal direction from) the opening position (front end) of the toner container 32 can form a cylindrical space between the front end of the toner container 32 and the front end faces of the container shutter 332 and the container seal 333.

In a configuration in which the container gear to mesh with the driving gear of the apparatus body is disposed in the front end portion of the bottle body, and the rear end portion of the bottle body includes a protrusion that contacts an internal projection projecting from an inner face of a bottle holder holding the bottle body, the possibility of damage to the container gear or the driving gear of the apparatus body can be higher.

More specifically, the orbit of the front end portion of the bottle body, where the container gear is provided, is preferably a perfect or almost perfect circle so that the container gear can properly mesh with the driving gear or the apparatus body. By contrast, the orbit of the rear end portion provided with the protrusion is eccentric since the protrusion overstrides the internal projection of the bottle holder. The eccentric movement of the rear end portion of the bottle body causes stress on the engagement between the container gear of the front end portion and the driving gear of the apparatus body, resulting in damage to them. A similar inconvenience can arise also in powder containers for containing powder other than toner.

In view of the foregoing, according to the embodiments of the present invention, coagulation of powder contained in a powder container can be loosened without causing a substantial eccentric movement of the powder chamber therein. This can be attained by configurations described below.

[First Configuration]

In FIG. 10, the bottle body 33 serving as the powder chamber includes the cover catch 306, the cover catch 306, the container gear 301, and the scooping portion 304, which are positioned in one end portion (i.e., the front end portion) in the axial direction of the bottle body 33. As shown in FIG. 6, the front end portion is rotationally held inside the container front cover 34.

Figure 19:
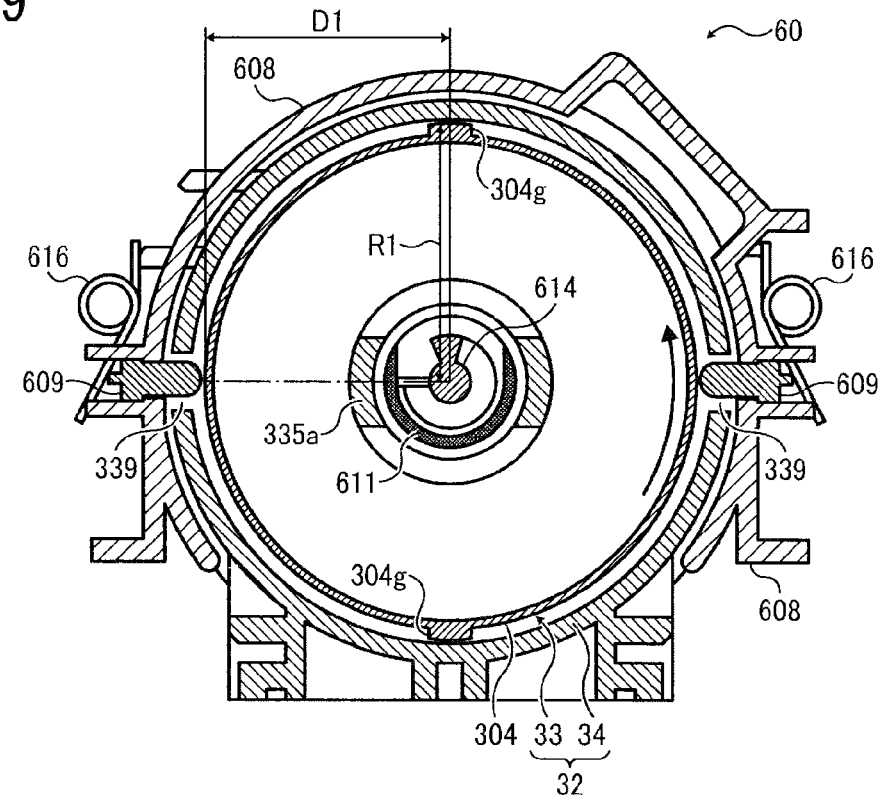
FIG. 19 is a cross sectional view illustrating a container socket of the toner replenishing device and a front end portion of a toner container held therein, according to a first configuration of the first embodiment.

FIG. 19 is a cross sectional view of the container socket 608 of the toner replenishing device 60 and the front end portion of the toner container 32 (the bottle body 33 and the container front cover 34) held therein. In FIG. 19, reference character D1 represents a distance to a front end of the container lock 609 from a center of rotation of the bottle body 33.

Referring FIG. 19, in a circumferential range of the scooping portion 304, a protrusion 304*g* projects from the outer circumferential surface of the scooping portion 304. In the configuration shown in FIG. 19, two protrusions 304*g* are formed on the outer circumferential surface of the scooping portion 304. The protrusion 304*g* revolves around the axial line of rotation of the bottle body 33, and a radius R1 of revolution of the protrusion 304*g* is greater than the radius of the container gear 301.

The two protrusions 304*g* are symmetrical about a point, namely, axis of rotation of the bottle body 33, with their phases shifted 180 degrees.

The amount by which the protrusion 304*g* projects from the outer circumferential surface of the scooping portion 304 is designed such that the radius R1 of orbit of revolution of the outer end of the protrusion 304*g* (around the axis of rotation of the bottle body 33) is smaller than the radius of inner circumference of the container front cover 34. A minute clearance is secured between the inner circumferential surface of the container front cover 34 and the outer end of the protrusion 304*g* of the scooping portion 304 being received inside the container front cover 34. Accordingly, as the scooping portion 304 rotates, the protrusion 304*g* revolves around the axis of rotation inside the container front cover 34.

Inside the container front cover 34, if movement of the front end portion of the bottle body 33 becomes eccentric, one of the two protrusions 304*g* contacts the inner circumferential surface of the container front cover 34, thereby stopping the eccentric movement. Therefore, the orbit of the front end portion of the bottle body 33 can be an almost perfect circle.

The two container engagement portions 339 are formed at predetermined circumferential positions in the container front cover 34, in which the scooping portion 304 is received. The container engagement portions 339 are symmetrical about a point, namely, axis of rotation of the bottle body 33.

The container socket 608 supports the two container locks 609 slidably. A torsion coil spring 616 urges each container lock 609 from outside the container socket 608, along a guiding groove formed in the container socket 608, to the axial line of the bottle body 33. A rear end of the container lock 609 (i.e., an outer end in the direction of diameter of the toner bottle 33 in FIG. 19) is thicker than its front end (i.e., an inner end in the direction of diameter) and blocked by a projection formed in the guiding groove although the container lock 609 is urged by the torsion coil spring 616 inward in the direction of diameter. Thus, the container lock 609 can be latched at a predetermined position in the urged direction.

With the front end portion of the toner container 32 received inside the container socket 608, the front end of the container lock 609, latched in the guiding groove, penetrates the container engagement portion 339 and enters the interior of the container front cover 34. However, the front end of the container lock 609 does not reach the outer circumferential surface of the scooping portion 304 as shown in FIG. 19. In other words, the front end of the container lock 609 being latched is positioned in the clearance between the inner circumferential surface of the container front cover 34 and the outer circumferential surface of the scooping portion 304 of the bottle body 33.

More specifically, in the radial direction centered on the axis of rotation of the bottle body 33, the front end position of the container lock 609 being latched is positioned outside the outer circumferential surface of the scooping portion 304 and inside the orbit of the protrusion 304*g* of the scooping portion 304. Accordingly, when the protrusion 304*g* of the scooping portion 304 approaches the position facing the container lock 609 as the bottle body 33 rotates, the protrusion 304*g* contacts the container lock 609 as shown in FIG. 20.

The two container locks 609 are symmetrical about the axis of rotation of the bottle body 33. Accordingly, as one of the protrusions 304*g* starts contacting the container lock 609, the other protrusion 304*g* also starts contacting the corresponding container lock 609. Therefore, the bottle body 33 does not become eccentric but can keep the orbit shaped into a substantially perfect circle.

Figure 21:
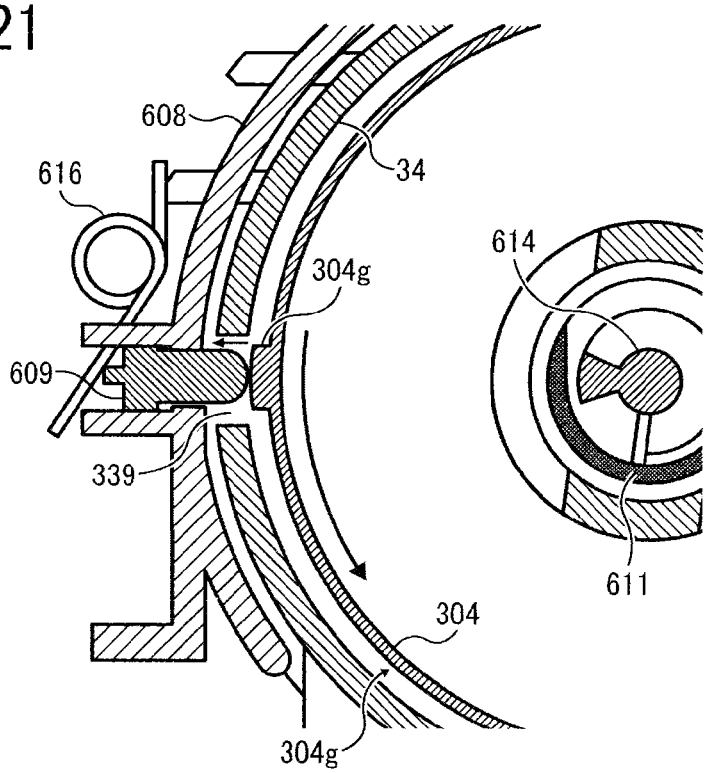
FIG. 21 is a cross-sectional view of the container socket and the bottle body being at a rotational position at which the protrusion fully faces the container lock.
Figure 22:
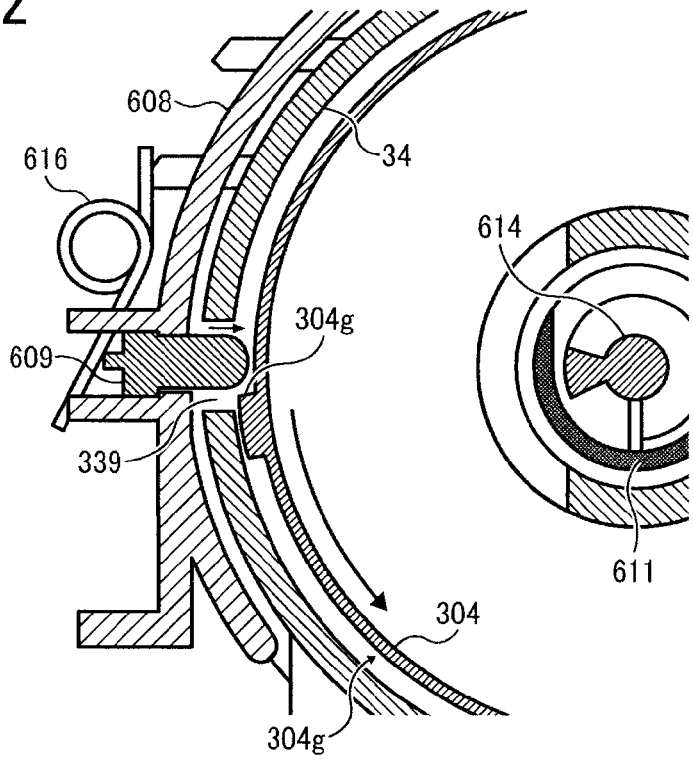
FIG. 22 is a cross-sectional view of the container socket and the bottle body being at a rotational position at which the protrusion is disengaged from the container lock.

The container lock 609 in contact with the protrusion 304*g* is pushed by the protrusion 304*g* outward in the radial direction centered on the axis of rotation. Thus, the container lock 609 moves outward in the radial direction, against the bias force exerted by the torsion coil spring 616. In other words, the container lock 609 changes its position away from the protrusion 304*g* on contact with the protrusion 304*g* and can serves as a movable contact member or a facing member. In this configuration, as the container lock 609 moves to the position to avoid the protrusion 304*g* as shown in FIG. 21, the bottle body 33 can keep revolving on the almost perfect circular orbit.

Figure 20:
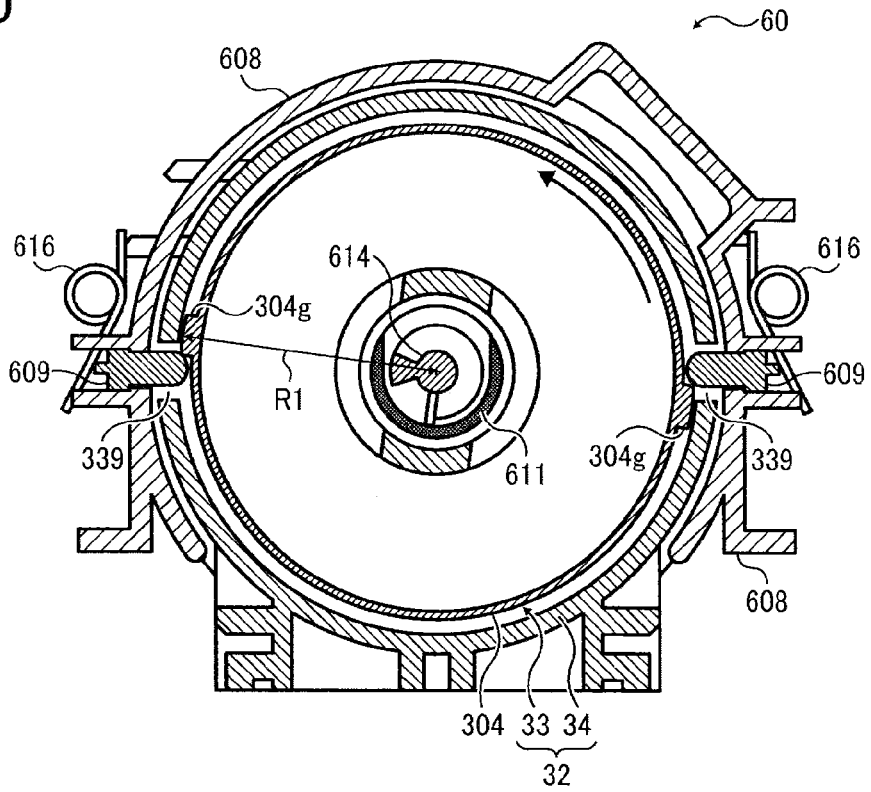
FIG. 20 is a cross-sectional view of the container socket and the bottle body being at a rotational position at which a protrusion starts contacting a container lock.

As shown in FIG. 20, when the revolving protrusion 304*g* contacts the container lock 609, the protrusion 304*g* receives force that inhibits rotations of the bottle body 33. At that time, vibration is given to the toner contained inside the bottle body 33, and coagulated toner can be loosened.

The scooping portion 304 is reduced in width compared with the bottle body 33 (powder chamber), and scooping capability may be degraded if toner adheres to the inner surface thereof, reducing the amount of toner supplied. Therefore, disposing the protrusion 304*g* to the scooping portion 304 is advantageous in that adhering toner can be separated from the inner surface of the scooping portion 304 by vibrating the scooping portion 304 progressively, thereby stabilizing the amount of toner supplied.

Although driving torque is increased by sliding between the protrusion 304*g* and the container lock 609, the driving torque returns to normal abruptly when the protrusion 304*g* is disengaged from the container lock 609. Accordingly, the rotational velocity of the bottle body 33 increases sharply for a moment, and vibration is given to the toner inside the bottle body 33. This vibration can loosen coagulation of toner similarly.

Figure 23:
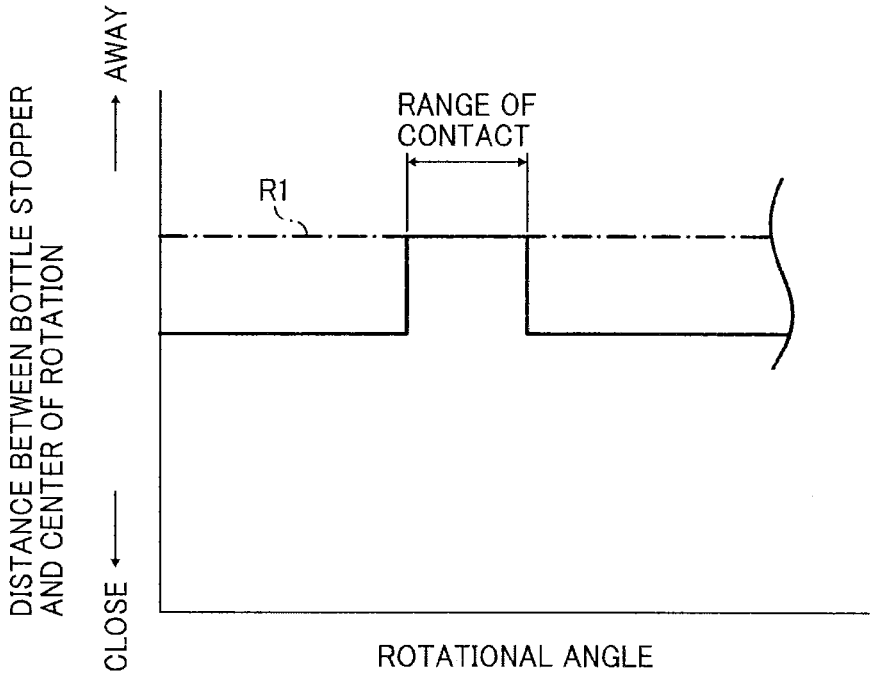
FIG. 23 is a graph illustrating a relation between the rotational angle of the bottle body and the distance to a front end of the container lock from a center of rotation of the bottle body.

FIG. 23 is a graph illustrating the relation between the rotational angle of the bottle body 33 and the distance to the front end of the container lock 609 from the center of rotation of the bottle body 33. In FIG. 23, "range of contact" means a rotational angle range of the bottle body 33 in which the container lock 609 contacts the protrusion 304*g*. When the container lock 609 starts contacting the protrusion 304*g*, the distance D1 from the axis of rotation to the front end of the container lock 609 is increased in one stroke to the radius R1 of revolution of the protrusion 304*g*. Thus, the container lock 609 moves in one stroke to the position not to be blocked by the protrusion 304*g* and starts sliding on the protrusion 304*g*. Additionally, when the front end of the container lock 609 starts moving away from the protrusion 304*g* as the bottle body 33 rotates, the distance D1 is reduced to the original distance in one stroke.

As described above, in the toner replenishing device 60 according to the present embodiment, coagulation of toner can be loosened without a substantial eccentric movement of the bottle body 33.

It is to be noted that, although the description above concerns the configuration in which the container engagement portion 339 is formed in the container front cover 34, serving as the holder for holding the movable container lock 609 from outside, alternatively, for example, the container lock 609 may be supported movably relative to the container front cover 34.

Yet alternatively, a protrusion facing the outer circumferential surface of the bottle body 33 may be formed on the inner circumferential surface of the container front cover 34, and a movable contact member may be supported by the bottle body 33. Specifically, the movable contact member is disposed to contact the protrusion of the container front cover 34 when the bottle body 33 reaches a predetermined rotational position, and, on contact with the protrusion, the movable member moves away from the protrusion in the radial direction.

The container lock 609 serves as a latch to retain the container front cover 34 when the container lock 609 is inside the container engagement portion 339. Use of the container lock 609 as both the lock for the toner container 32 and the movable contact member is advantageous in that component layout can be simpler compared with a configuration using separate members for them.

[Second Configuration]

Figure 24:
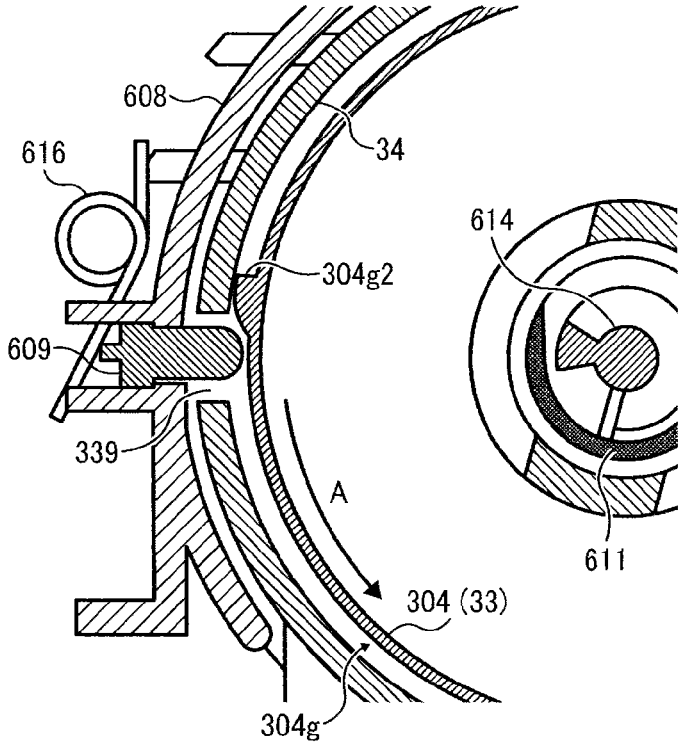
FIG. 24 is a cross sectional view illustrating a container socket of a toner replenishing device and a front end portion of a toner container held therein, according to a second configuration of the first embodiment.

FIG. 24 is a cross sectional view of the container socket 608 of the toner replenishing device 60 and the front end portion of the toner container 32 (the bottle body 33 and the container front cover 34) according to a second configuration usable in the toner replenishing device and the toner container according to the present embodiment. Other than the differences described below, the toner replenishing device and the toner container shown in FIGS. 24 and 25 are similar to those described with reference to FIGS. 19 through 23.

In the configuration shown in FIG. 24, a tapered protrusion 304*g*2 is formed on the outer circumferential surface of the scooping portion 304 of the bottle body 33. Specifically, the outer end (in the radial direction) of the protrusion 304*g*2 is tapered to move away from the axis of rotation toward the rear side in the direction A in which the bottle body 33 rotates so that the distance D1 (shown in FIG. 19) from the axis of rotation to the container lock 609 in contact with the protrusion 304*g*2 increases as the bottle body 33 rotates.

Figure 25:
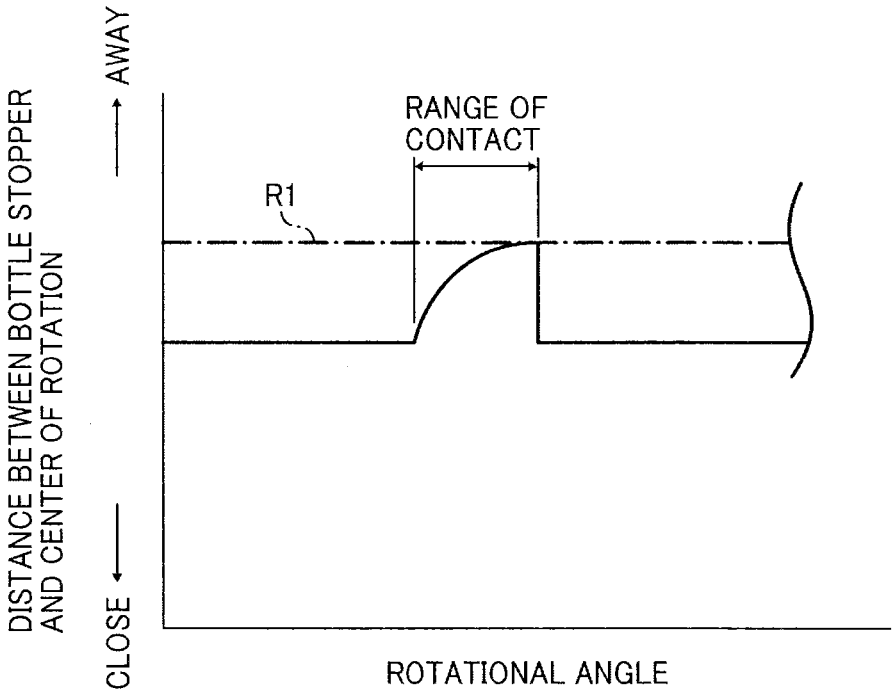
FIG. 25 is a graph illustrating the relation between the rotational angle of the bottle body and the distance to a front end of the container lock from a center of rotation of the bottle body.

FIG. 25 is a graph illustrating the relation between the rotational angle of the bottle body 33 and the distance to a front end of the container lock 609 from a center of rotation of the bottle body 33. As shown in FIG. 25, when the container lock 609 starts contacting the tapered protrusion 304*g*2, the distance D1 from the axis of rotation to the front end of the container lock 609 is increases gradually. The distance D1 becomes equal to the radius R1 of revolution of the protrusion 304*g* immediately before the container lock 609 is disengaged from the protrusion 304*g*2. Then, the distance D1 decreases in one stroke to the original (shown in FIG. 19) after the container lock 609 avoids the protrusion 304*g*2.

This configuration can alleviate the impact to each of the protrusion 304*g*2 and the container lock 609 at the start of contact therebetween. Accordingly, damage to the protrusion 304*g*2 or the container lock 609 can be inhibited.

[Variation]

Variations of the container locks according to the first embodiment are described below. Other than the differences described below, the configurations shown in FIGS. 26 through 29 are similar to those described with reference to FIGS. 19 through 23.

Figure 26:
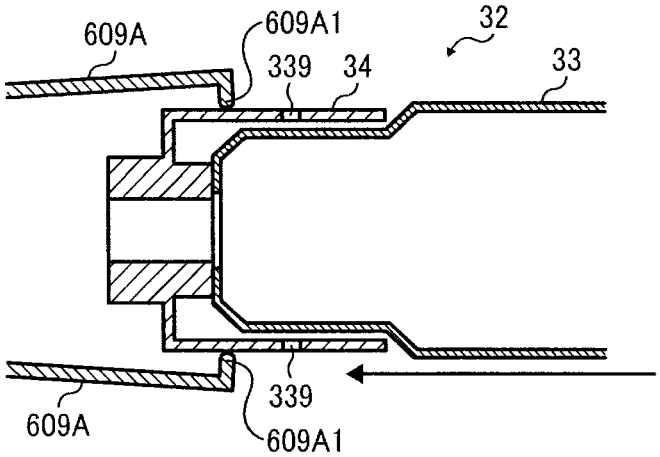
FIG. 26 is a cross sectional view of a first variation of the container lock and the front end portion of the toner container immediately before received in the container socket.

FIG. 26 is a cross sectional view of two container locks 609A according to a first variation and the front end portion of the toner container 32 immediately before received in the container socket 608 (shown in FIG. 8). The two container locks 609A each extending in the axial direction of the bottle body 33 are cantilevered by supporting members. The cantilevered end of the container lock 609A is on the front side of the bottle body 33, whereas a free end of the lock 609A is on the rear side of the bottle body 33.

The free end of the container lock 609A is bent at 90 degrees from the axial direction of the bottle body 33 toward the axial line. The bent portion is referred to as a lock claw 609A1. When insertion of the front end portion of the toner container 32 into the container socket 608 is started, the lock claws 609A1 of the respective container locks 609A contact the outer surface of the container front cover 34 as shown in FIG. 26. Then, each container lock 609A deforms for the length of the lock claw 609A in the direction away from the axial direction of the bottle body 33.

Figure 27:
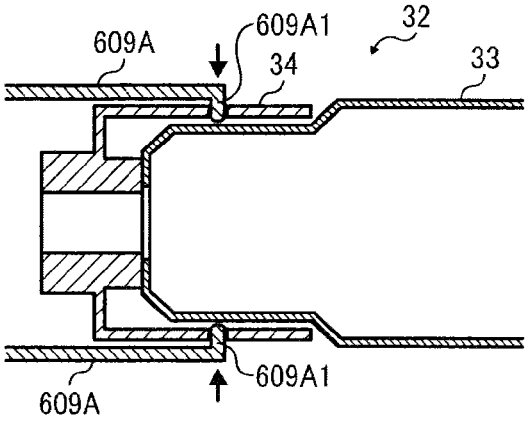
FIG. 27 is a cross sectional view of the container lock shown in FIG. 26 and the front end portion of the toner container being received in the container socket.

When the toner container 32 is fully received in the container socket 608, the lock claw 609A1 of the container lock 609A enters the container engagement portion 339 formed in the container front cover 34 as shown in FIG. 27. At that time, the deformed container locks 609A revert to the original positions, hitting the outer circumferential surface of the bottle body 33. Thus, vibration is given to the toner contained inside the bottle body 33 and coagulated toner can be loosened.

[Second Variation]

Figure 28:
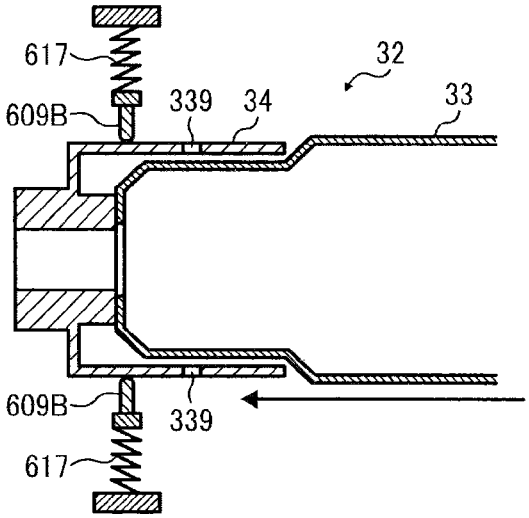
FIG. 28 is a cross sectional view of a second variation of the container lock and the front end portion of the toner container immediately before received in the container socket.

FIG. 28 is a cross sectional view of container locks 609B according to a second variation and the front end portion of the toner container 32 immediately before received in the container socket. The two container locks 609B each extending in a direction perpendicular to the axial direction of the bottle body 33 are biased by coil springs 607 from outside toward the axial line of the bottle body 33.

Figure 29:
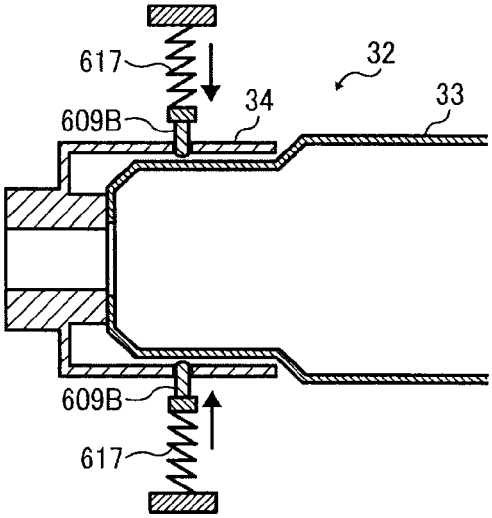
FIG. 29 is a cross sectional view of the container lock shown in FIG. 28 and the front end portion of the toner container being received in the container socket.

When insertion of the front end portion of the toner container 32 into the container socket 608 is started, as shown in FIG. 28, the two container locks 609B contact the outer circumferential surface of the toner container 32. When the toner container 32 is fully received in the container socket 608, the container locks 609B enter the respective container engagement portions 339 formed in the container front cover 34 as shown in FIG. 29. At that time, the front end of each container lock 609B biased by the coil spring 617 hits the outer circumferential surface of the bottle body 33. Thus, vibration is given to the toner contained inside the bottle body 33 and coagulated toner can be loosened.

The various configurations according to the first embodiment can attain specific effects as follows.

Configuration A: A powder container (such as the toner container 32) includes a rotatable powder chamber (such as the bottle body 33) for containing powder and a holder (such as the container front cover 34) to rotatably hold an end portion of the powder container on one side in the axial direction of the powder chamber and configured to transport powder from the other side to the end portion as the powder chamber rotates and discharge the powder from the powder chamber. In this powder container, a protrusion (such as the protrusion 304g) projects from an outer circumferential surface of the axial end portion of the powder chamber. The projecting amount is smaller than the gap between the inner circumferential surface of the holder and the outer circumferential surface of the powder chamber so that the radius (R1) of orbit of revolution (around the axial line thereof) is smaller than the radius of inner circumference of the holder. When the powder chamber is at a predetermined rotational position, a movable contact member (such as the container lock 609) provided to the holder contacts the protrusion and moves away from the protrusion, avoiding the protrusion. Alternatively, an opening (such as the container engagement portion 339) is formed in the holder for receiving the movable contact member from the outside of the holder.

Configuration B: A powder replenishing device includes the powder container according to configuration A and a conveyance channel (such as the vertical toner tube 64) through which powder flows from the powder container to a destination.

Configuration C: In configuration B, an end of the protrusion is tapered such that the outer end (in the radial direction) thereof deviates from the axis of rotation as the powder chamber rotates downstream in the direction of rotation thereof. This configuration can alleviate the impact to each of the protrusion and the movable contact member at the start of contact therebetween.

Configuration D: In configuration B or C, the movable contact member is provided separately from the holder, the opening for receiving the movable contact member is formed in the holder, and the movable contact member being inserted into the opening serves as a retainer to retain the holder. The configuration in which the movable contact member is used also as the retainer is advantageous in that component layout can be simpler.

In the first embodiment, when the powder chamber of the powder container is at a predetermined rotational position, a protrusion formed on the outer circumferential surface of the powder chamber contacts a movable contact member disposed facing the protrusion. Alternatively, a movable contact member supported by the powder chamber contacts a facing member disposed facing the outer circumferential surface of the powder chamber. In either case, on contact between the movable contact member and the facing member facing it, force to inhibit rotation of the powder chamber is generated, giving the powder chamber an impact in the direction of rotation. The impact can loosen coagulation of toner inside the powder chamber.

Subsequently, as the powder chamber rotates further, the movable contact member in contact with the protrusion of the powder chamber, or the movable contact member retained by the powder chamber and in contact with the facing member, moves in the radial direction, away from the protrusion or the facing member to avoid the protrusion or the facing member. With this movement, while the powder chamber follows an almost perfect circle orbit, the protrusion of the powder chamber passes by the contact position with the movable contact member, or the movable contact member of the powder chamber passes by the facing member.

Thus, while the powder chamber rotating along an almost perfect circle orbit, the powder chamber can be vibrated in the direction of rotation by the movable contact member that periodically contacts the protrusion of the powder chamber, or the movable contact member of the powder chamber that periodically contacts the facing member. Thus, coagulated powder can be loosened without causing a substantial eccentric movement of the powder chamber.

Second Embodiment

A second embodiment is described below. Descriptions of features of the second embodiment similar to those of the above-described first embodiment are omitted.

In the toner replenishing device 60, the toner container 32 is replaced when no or almost no toner remains in the bottle body 33 (toner end). Therefore, it is preferable that "toner end" is detected, and users are advised to replace the toner container 32.

As described above, in the configuration including the temporary toner reservoir for temporarily storing toner discharged from a toner container to be supplied to the developing device, typically a toner end detector is provided to the temporary toner reservoir. When the toner container becomes empty, no toner is supplied to the temporary toner reservoir, and the level of toner therein falls under the lower limit. Then, the toner end detector does not detect the presence of toner. Thus, "toner end" in the toner container can be detected according to the detection made by the toner end detector in the temporary toner reservoir.

However, in this configuration, the temporary toner reservoir is required to detect "toner end" in the toner container. A similar inconvenience can arise also in powder containers for containing powder other than toner.

In view of the foregoing, the second embodiment is designed to detect the amount of toner remaining in the powder chamber (i.e., the bottle body 33) of the powder container (i.e., the toner container 32) without providing a temporary reservoir for temporarily storing powder discharged from the powder container.

It is to be noted that the toner container 32 according to the second embodiment includes the protrusion 304*g* for loosening toner coagulation similarly to the first embodiment with reference to FIGS. 19 through 25.

Next, a feature of the present embodiment is described in further detail below.

In FIG. 10, the bottle body 33 serving as a powder chamber includes the cover catch 306, the container gear 301, and the scooping portion 304, which are positioned in one end portion (i.e., the front end portion) in the axial direction of the bottle body 33. As shown in FIG. 6, the front end portion is rotationally held inside the container front cover 34. In the second embodiment, an axial area of the bottle body 33 is transparent entirely in the circumferential direction. More specifically, a cylindrical wall of the scooping portion 304 is formed with a light transmissive material entirely in the circumferential direction. Thus, the scooping portion 304 serves as a window. It is to be noted that, in FIG. 10, a number of dots in the scooping portion 304 represent toner visible from outside the bottle body 33.

FIG. 30 is a cross sectional view of the container socket 608 of the toner replenishing device 60 and the front end portion of the toner container 32 held therein. FIG. 30 illustrates the portion of the toner replenishing device 60 where the scooping portion 304 is positioned in the axial direction. In the configuration shown in FIG. 30, the front end portion of the scooping portion 304 is not cylindrical but oblate or shaped like a low-profile box. The scooping portion 304 is formed with a transparent material entirely in the direction of rotation. Alternatively, the scooping portion 304 may be translucent.

First and second openings 337 and 338 are formed in a container front cover 34-2 according to the second embodiment, which receives the front end portion of the bottle body 33. The first opening 337 is adjacent to and on the right of the scooping portion 304 in FIG. 30, and the second opening 338 is adjacent to and on the left of the scooping portion 304 in FIG. 30.

The toner replenishing device 60 includes a light-emitting element 620 and a light-receiving element 621. A toner supply controller is constructed of a central processing unit (CPU) as well as data storage units such as a random access memory (RAM), and a read only memory (ROM). The light-emitting element 620, the light-receiving element 621, and the toner supply controller together form a toner amount detector for detecting the amount of toner remaining in the bottle body 33.

The light-emitting element 620 and the light-receiving element 621 are arranged as follows in a direction along the surface of the paper on which FIG. 30 is drawn, which is perpendicular to the axial direction of the bottle body 33. That is, the light-emitting element 620 faces the light-receiving element 621 via the second opening 338 of the container front cover 34-2, the scooping portion 304 of the bottle body 33, and the first opening 337 of the container front cover 34-2. As indicated by broken lines in FIG. 30, light emitted from the light-emitting element 620, for example, a light-emitting diode (LED), enters the container front cover 34-2 through the second opening 338 and penetrates the wall of the scooping portion 304 serving as the transparent window.

Since the wall of the scooping portion 304 is transparent entirely in the direction of rotation, light entering the container front cover 34-2 through the second opening 338 can penetrate the scooping portion 304 regardless of the rotational position of the scooping portion 304. When the amount of toner remaining in the scooping portion 304 is reduced a certain amount, a part of the light again penetrates the transparent scooping portion 304 to the outside of the scooping portion 304 after traveling inside the scooping portion 304. The light further travels through the first opening 337 outside the container front cover 34-2 and is received by the light-receiving element 621.

The amount of light received by the light-receiving element 621 correlates with the amount of toner remaining in the scooping portion 304. Specifically, as the amount of toner remaining in the toner container 32 decreases, the amount of toner in the scooping portion 304 decreases, and the amount of light received by the light-receiving element 621 increases. Then, the voltage output from the light-receiving element 621 increases. Accordingly, an algorithm correlating the amount of light received by the light-receiving element 621 with the amount of remaining toner can be prestored in the toner supply controller so that the amount of remaining toner can be calculated using the algorithm and the voltage output from the light-receiving element 621. When the amount of remaining toner falls below a threshold, "toner end" can be displayed on a display.

Figure 31:
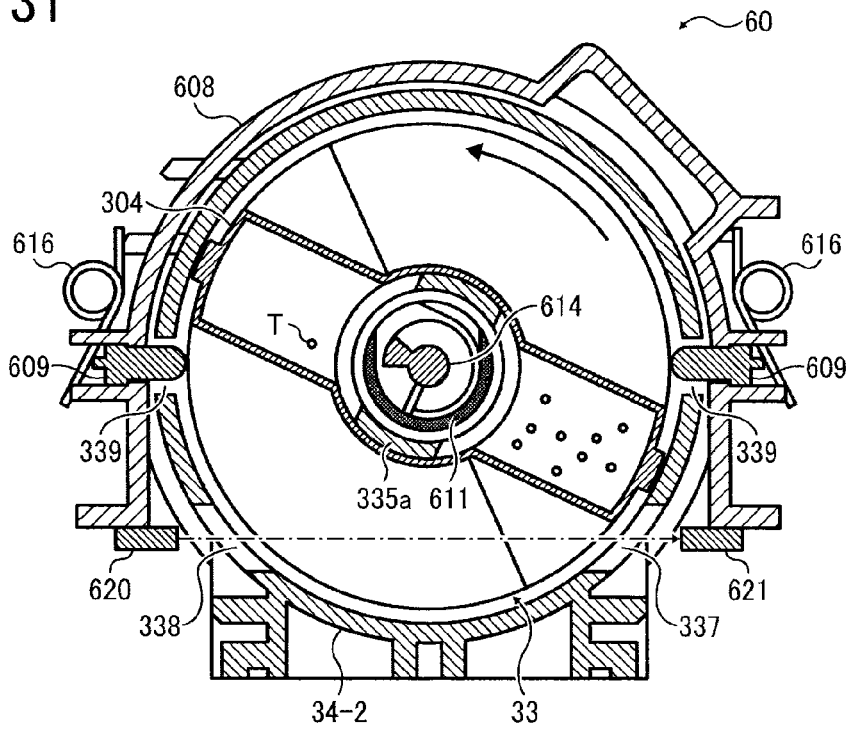
FIG. 31 is a cross-sectional view of the bottle body at a certain angle from the state shown in FIG. 30, received in the toner replenishing device.

It is to be noted that, due to the scooping portion 304 shaped like a low-profile box (FIG. 30 illustrates a cross section of the low-profile box shape), depending on the rotational angle of the bottle body 33, the scooping portion 304 is not present in the light path between the light-emitting element 620 and the light-receiving element 621, and light reaches directly from the light-emitting element 620 to the light-receiving element 621 as shown in FIG. 31. The amount of light received by the light-receiving element 621 at that time does not correlate with the amount of remaining toner. Therefore, the toner supply controller calculates a mean value of the amount of light received in a predetermined period and obtains the amount of remaining toner based on the mean value. The predetermined period is longer than the duration of time required for a complete turn of the bottle body 33. Since the mean value of the amount of light received in such period can correlate with the amount of toner remaining in the front end portion shaped like a low-profile box, the amount of remaining toner can be ascertained.

This configuration enables detection of the amount of toner remaining in the bottle body 33 without providing the temporary toner reservoir for temporarily storing toner discharged from the toner container 32 since the amount of toner in the scooping portion 304, not the amount of toner discharged from the toner container 32, can be detected using transmitted light.

It is to be noted that, since the rear portion of the scooping portion 304 in the axial direction is cylindrical, the light-receiving element 621 may be disposed to receive light emitted from the light-emitting element 620 at the position of the cylindrical rear portion thereof.

The front end portion of the bottle body 33 in the axial direction thereof is received in the container front cover 34-2, and the scooping portion 304 shown in FIG. 30 is positioned in the front end portion received in the container front cover 34-2. In other words, in the toner replenishing device 60 according to the present embodiment, the front end portion of the bottle body 33 includes the window.

Referring to FIG. 30, since the window (i.e., the scooping portion 304) is received inside the container front cover 34-2, the first and second openings 337 and 338 are formed in the container front cover 34-2 so that light emitted from the light-emitting element 620 can pass through the container front cover 34-2 before and after penetrating the scooping portion 304.

As toner is consumed, the level of toner inside the bottle body 33 is substantially reduced in the entire axial length thereof, which is a state referred to as "toner near end". In this specification, reduction in the amount of remaining toner from this state is divided in three levels. In a first reduction level, a small amount of toner is still present in the entire axial length of the bottle body 33.

As the amount of toner decreases further, no or almost not toner is present in the rear end portion of the bottle body 33, but a certain amount of toner remains in the front end portion thereof, which is a state close to "toner end" and hereinafter referred to as "second reduction level". That is, a small amount of toner remains in this state.

As the mount of toner decreases further, the level of toner in the front end portion of the bottle body 33 decreases substantially. The term "toner end" used in this specification means this state. If the window is disposed in the rear end portion of the bottle body 33, the state in which almost no toner is present in the rear end portion is detected based on changes in the amount of light received by the light-receiving element 621. This state, however, is the above-described second reduction level and is slightly earlier than the time when the bottle body 33 becomes empty (toner end).

By contrast, when the window is disposed in the front end portion of the bottle body 33 as in the present embodiment, based on changes in the amount of light received by the light-receiving element 621, the state in which almost no toner is present in the front end portion can be detected. In other words, the state of "toner end" can be detected. Thus, disposing the window in the front end portion of the bottle body 33 can enable more accurate detection of the timing when the toner bottle becomes empty (toner end).

In FIG. 30, the axial line of the bottle body 33 is a circular center of the conveying screw 614. As shown in FIG. 30, in the present embodiment, the first and second openings 337 and 338 face each other at a position lower (in the direction of gravity) than the axial line inside the scooping portion 304. With this arrangement, it can be known that the level of toner in the scooping portion 304 is substantially lower than the axial line based on changes in the amount of light received by the light-receiving element 621. Accordingly, detection of the timing when the toner bottle is empty (toner end) can be more accurate compared with a configuration in which these openings are positioned above the axial line.

It is to be noted that, although the two container engagement portions 339 and the first and second openings 337 and 338 are provided separately in the container front cover 34-2 in the configuration shown in FIG. 30, these openings may be configured otherwise. Alternatively, for example, the container engagement portion 339 on the left in FIG. 30 may be continuous with the second opening 338, forming a single opening, and the container engagement portion 339 on the right may be continuous with the first opening 337, forming a single opening.

Figure 32:
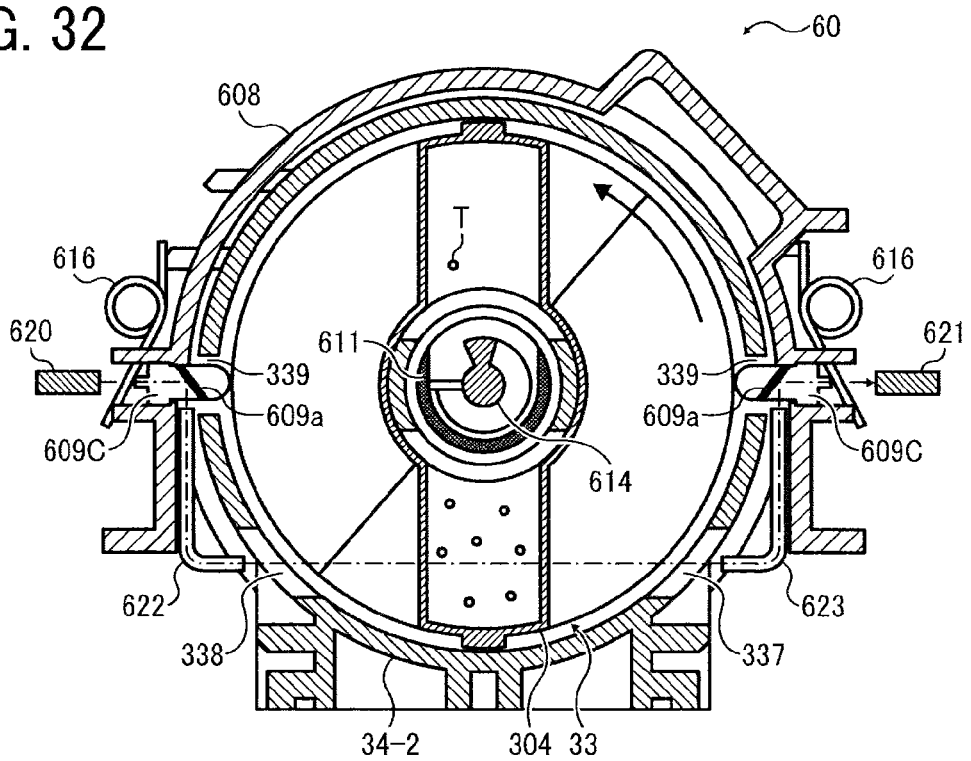
FIG. 32 is a cross sectional view of a toner replenishing device and a front end portion of a toner container according to a first configuration of the second embodiment.
Figure 33:
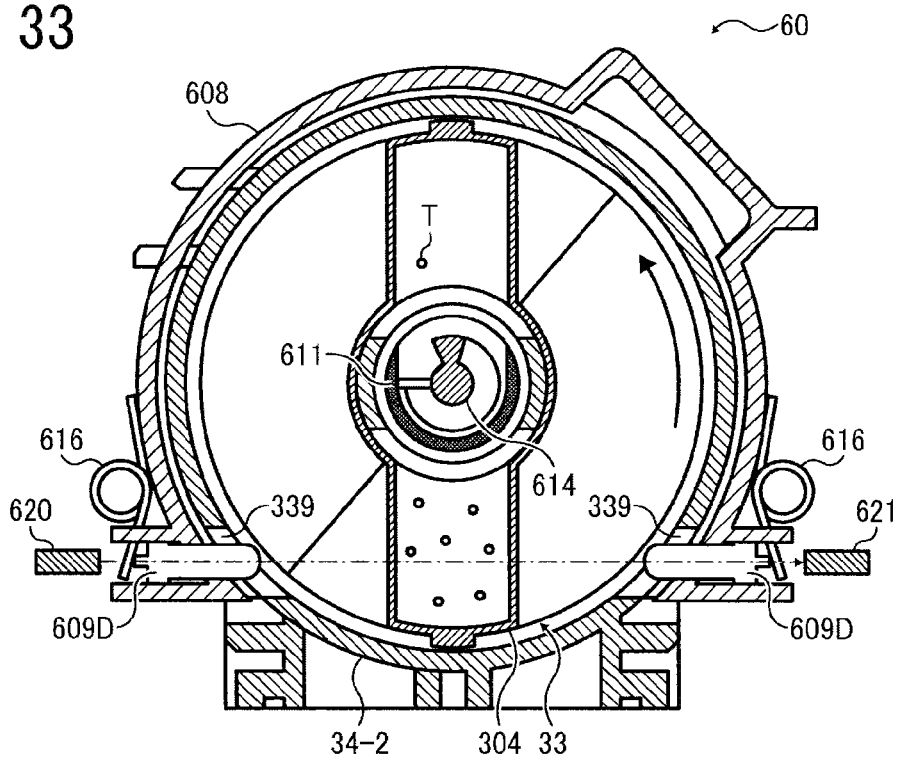
FIG. 33 is a cross sectional view of a toner replenishing device and a toner container according to a second configuration of the second embodiment.

Next, configurations applicable to the toner replenishing device according to the second embodiment are described with reference to FIGS. 32 and 33. Other than the differences described below, the toner replenishing device and the toner container shown in FIGS. 32 and 33 are similar to those described with reference to FIGS. 30 and 31. It is to be noted that, in FIGS. 32 and 33, hatching of the container locks 609 is omitted since they are formed with a transparent material.

[First Configuration]

FIG. 32 is a cross sectional view of the toner replenishing device 60 and the front end portion of the toner container 32 (the bottle body 33 and the container front cover 34-2) according to a first configuration.

In the configuration shown in FIG. 32, the toner replenishing device 60 includes two container locks 609C formed with transparent plastic. A reflecting mirror 609*a* is provided in each container lock 609C. The light-emitting element 620 is disposed facing the container engagement portion 339 on the left in FIG. 32, formed in the container front cover 34-2. The light-receiving element 621 is disposed facing the container engagement portion 339 on the right in FIG. 32, formed in the container front cover 34-2.

The light emitted from the light-emitting element 620 enters the container lock 609C on the left in FIG. 30 and then travels downward, being deflected 90 degrees by the reflecting mirror 609*a* of the container lock 609C. A first optical cable 622 shaped like a letter "L" is provided beneath the container lock 609C on the left, overlapping the container lock 609 in the vertical direction. The light deflected by the reflecting mirror 609*a* of the container lock 609C on the left enters the first optical cable 622. Along the L-shaped first optical cable 622, the light descends and is deflected in a horizontal direction. Then, the light is directed to the second opening 338 formed in the container front cover 34-2.

Subsequently, the light travels through the second opening 338, the scooping portion 304 of the bottle body 33, and the first opening 337 and enters an L-shaped second optical cable 623. After deflected and guided upward along the L-shaped second optical cable 623, the light exits the second optical cable 623 and enters the transparent container lock 609C on the right. After the reflecting mirror 609*a* of the container lock 609 deflects the light, the light-receiving element 621 receives the light.

In this configuration, light can be transmitted between the light-emitting element 620 and the light-receiving element 621 using the space where the container locks 609C are provided.

[Second Configuration]

A second configuration usable in the second embodiment is described below with reference to FIG. 33, which is a cross sectional view of the toner replenishing device 60 and the front end portion of the toner container 32 (the bottle body 33 and the container front cover 34-2). In the second configuration, two container locks 609D formed with a transparent plastic are used. However, the container locks 609D do not include reflecting mirrors differently from the configuration shown in FIG. 32.

In the configuration shown in FIG. 33, the container engagement portion 339 on the left in FIG. 33 serves also as an opening for receiving light. The container engagement portion 339 on the right in FIG. 33 serves also as an opening for discharging light.

The light emitted from the light-emitting element 620 penetrates the container lock 609D inserted in the container engagement portion 339 on the left, enters the container front cover 34-2, and then penetrates the scooping portion 304. Subsequently, the light penetrates the container lock 609D inserted in the container engagement portion 339 on the right, exits the container front cover 34-2, and then reaches the light-receiving element 621.

In this configuration, light can be transmitted between the light-emitting element 620 and the light-receiving element 621 using the space of the container engagement portions 339 and the container locks 609D.

Third Embodiment

A toner container according to a third embodiment is described below. Other than the differences described below, the container shown in FIG. 34 is similar to the above-described embodiments.

Figure 34:
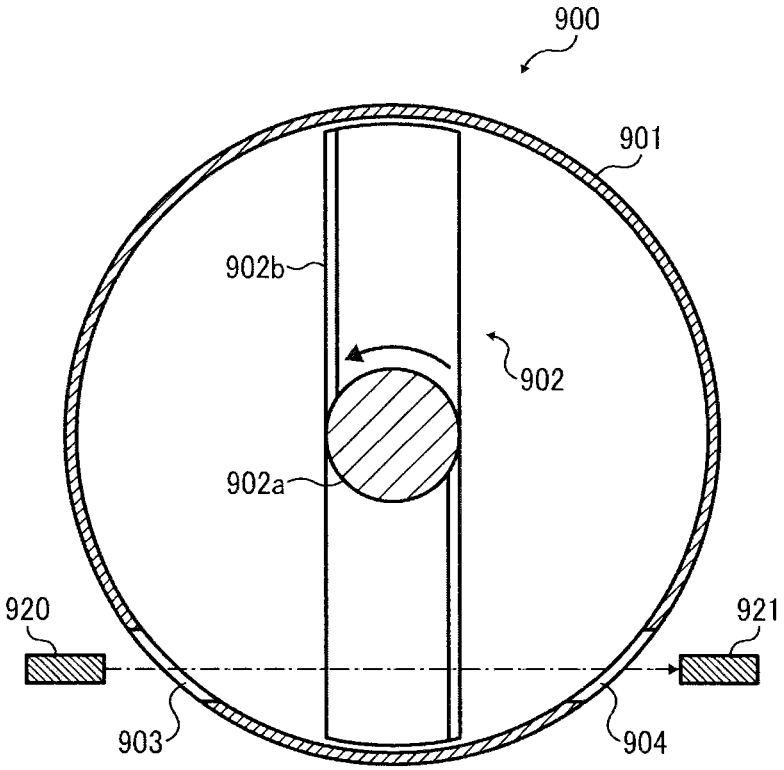
FIG. 34 is a cross sectional view of a toner container and the adjacent configuration according to a third embodiment.

FIG. 34 is a cross sectional view of a toner container 900 and the adjacent configuration usable in the toner replenishing device 60.

The toner container 900 shown in FIG. 34 includes a toner bottle 901 and a toner conveying member 902 disposed at the center of circular profile of the toner bottle 901, extending in the axial line of the toner bottle 901. The toner conveying member 902 includes a rotary shaft 902*a* extending in the axial line and rotatably supported and multiple blades 902*b*. The multiple blades 902*b* are arranged along the axial line (in the direction perpendicular to the surface of the paper on which FIG. 34 is drawn) although only a single blade 902*b* is illustrated in FIG. 34. The multiple blades 902*b* arranged along the axial line are fixed to the rotary shaft 902*a*.

The rotary shaft 902*a* is connected to a drive device outside the toner bottle 901. As the drive device rotates the rotary shaft 902*a*, the multiple blades 902*b* rotate, thereby transporting toner from the rear side to the front side inside the toner bottle 901.

In a front end portion of the toner bottle 901, a first window 903 for introducing light from outside the toner bottle 901 and a second window 904 for discharging the light outside the toner bottle 901 are formed. The first window 903 faces the second window 904 via an interior of the toner bottle 901 in the direction (on a cross section of the toner bottle 901) perpendicular to the axial line thereof.

Outside the toner bottle 901, a light-emitting element 920 faces the first window 903 formed in the toner bottle 901. Additionally, a light-receiving element 921 faces the second window 904 formed in the toner bottle 901. The first and second windows 903 and 904 are formed with transparent plastic or transparent glass.

The light emitted from the light-emitting element 920 inters the toner bottle 901 through the first window 903. The light travels inside the toner bottle 901 along the cross sectional plane shown in FIG. 34, exits the toner bottle 901 through the second window 904, and then light-receiving element 921. The toner supply controller can ascertain the amount of toner remaining in the toner bottle 901 based on the amount of received light. Also in this configuration, whether the toner bottle 901 is empty can be detected without providing the temporary toner reservoir.

As described above, the specification of the present invention also provides the following configurations.

Configuration 1: A powder container includes a rotatable powder chamber for containing powder and a holder to rotatably hold an end portion of the powder container on one side in the axial direction or longitudinal direction of the powder chamber and configured to transport powder from the other side to the end portion as the powder chamber rotates and discharge the powder from the powder chamber. In this powder container, a window is formed with a light transmissive material in at least a part of the powder chamber in the axial direction thereof to transmit light through the powder chamber in a direction perpendicular to the axial direction.

Configuration 2: In configuration 1, the window extends entirely in the direction of rotation of the powder chamber.

Configuration 3: In a powder replenishing device that includes the powder container according to configuration 1 or 2 and a conveyance member to transport powder from the powder container to a destination, further a light-emitting element, a light-receiving element, and a powder amount detector are provided. The light-emitting element and the light-receiving element are disposed facing each other via the window in the direction perpendicular to the axial direction. Light emitted from the light-emitting element enters an interior of the powder chamber through the window, travels inside the powder chamber, exits the powder chamber through the window, and is received by the light-receiving element. The powder amount detector is configured to detect the amount of powder remaining in the powder chamber based on the detection result generated by the light-receiving element.

Configuration 4: In configuration 3, the window is positioned in the axial end portion received in the holder, and first and second openings are formed in the holder to guide external light into the axial end portion of the powder chamber and guide the light from inside the powder chamber to the outside of the holder.

Configuration 5: In configuration 4, the first and second openings are disposed to face each other at a position lower (in the direction of gravity) than the axial line in the holder.

Configuration 6: In configuration 5, the powder replenishing device further includes at least two retaining holes formed in the holder and at least two retainers inserted into the respective retaining holes to retain the holder. The two retaining holes respectively serve as the first and second openings to guide light into and out of the holder.

Configuration 7: In configuration 6, the retainers are formed with a transparent material.

Configuration 8: In a powder container including a powder chamber for containing powder and a powder conveying member to transport by rotation powder inside the powder chamber, two light transmission windows are formed in the powder chamber to guide external light to an interior of the powder chamber and discharge the light from inside the powder chamber.

Configuration 9: In a powder replenishing device including the powder container according to configuration 8 and a conveyance member to transport powder from the powder container to a destination, further a light-emitting element, a light-receiving element, and a powder amount detector are provided. The light-emitting element is disposed outside the powder chamber to face one of the light transmission windows, and the light-receiving element is disposed outside the powder chamber to face the other light transmission window. Light emitted from the light-emitting element enters an interior of the powder chamber through the light transmission window, travels inside the powder chamber, exits the powder chamber through the other light transmission window, and is received by the light-receiving element. The powder amount detector is configured to detect the amount of powder remaining in the powder chamber based on the detection result generated by the light-receiving element.

Configuration 10: An image forming apparatus includes the toner replenishing device according to any of configurations 1 through 7, or the powder replenishing device according to configuration 9.

The above-described configurations 1 to 10 can attain the following effects.

According to configurations 1 through 7 and configuration 10, external light directed to the window formed in the powder chamber enters the powder chamber through the window. When the amount of powder in the powder chamber is reduced a certain amount, a part of the light travels inside the powder chamber in the direction perpendicular to the axial direction and exits through the winder outside the powder chamber. In this configuration, when the light-emitting element is disposed facing the light-receiving element via the window in the direction perpendicular to the axial direction, the light-receiving element can receive the light that has been emitted from the light-emitting element and passed through the window and the interior of the powder chamber. Accordingly, the amount of powder remaining in the powder chamber can be detected based on the amount of light received by the light-receiving element. Since the amount of toner remaining in the powder chamber of the powder container not the amount of powder discharged from the powder chamber is detected, the amount of powder remaining in the powder chamber can be detected without providing a temporary reservoir for temporarily storing powder discharged from the powder container.

According to configuration 8 and 9, when the light-emitting element and the light receiving-element are disposed facing the respective light transmission windows formed in the powder chamber, the amount of powder remaining in the powder chamber can be detected based on the amount of light received by the light-receiving element after the light emitted from the light-emitting element travels the interior of the powder chamber. Also in this configuration, since the amount of toner remaining in the powder chamber of the powder container is detected, the amount of powder remaining in the powder chamber can be detected without providing a temporary reservoir for temporarily storing powder discharged from the powder container.

Numerous additional modifications and variations are possible in light of the above teachings. It is therefore to be understood that, within the scope of the appended claims, the disclosure of this patent specification may be practiced otherwise than as specifically described herein.

What is claimed is:

1. A powder container comprising:

a cylindrical powder chamber for containing powder used for forming images, including an opening on a first side in an axial direction of the powder container;

a conveyor disposed within the cylindrical powder chamber to transport powder contained in the cylindrical powder chamber to the first side from a second side in the axial direction;

an end cover to rotatably hold the cylindrical powder chamber; and a protrusion radially projecting from an outer circumferential surface of the cylindrical powder chamber at the first side, the protrusion disposed in a circumferential area of the cylindrical powder chamber, wherein the protrusion protrudes such that a radius of revolution of the protrusion is across a first facing member in a rotational direction of the powder chamber and the protrusion contacts the first facing member as the powder chamber rotates, the first facing member extends towards and faces the outer circumferential surface of the cylindrical powder chamber and serves as a retainer to retain the end cover at a predetermined position, and wherein an axial end portion on the first side of the powder chamber comprises a scooping portion to scoop up powder inside the powder chamber by rotation of the powder chamber, an inner circumferential surface of the scooping portion extends inward in the powder chamber, and the protrusion projects outward from an outer circumferential surface of the scooping portion.

2. The powder container according to claim 1, wherein the protrusion is tapered such that an upstream side of the protrusion in a direction of rotation of the powder chamber projects more than a downstream side thereof.

3. The powder container according to claim 1, wherein the first facing member moves upon contact with the protrusion of the powder chamber.

4. The powder container according to claim 1, wherein the conveyor comprises a spiral protrusion projecting inward from an inner circumferential surface of the powder chamber.

5. The powder container according to claim 1, further comprising:

a nozzle receiver provided in the opening of the powder chamber, the nozzle receiver having a nozzle connecting opening that receives a conveying nozzle of an image forming apparatus to transport powder from the powder container to the image forming apparatus; and a shutter to close the nozzle connecting opening.

6. The powder container according to claim 5, further comprising a second facing member disposed facing the outer circumferential surface of the powder chamber, wherein the second facing member is disposed opposite the first facing member across the nozzle receiver.

7. The powder container according to claim 1, further comprising a window formed with a light transmissive material in at least a part of the cylindrical powder chamber in the axial direction thereof, the window to transmit light through the cylindrical powder chamber in a direction perpendicular to the axial direction.

8. The powder container according to claim 7, wherein the window extends entirely in a direction of rotation of the powder chamber.

9. The powder container according to claim 7, further comprising the end cover to rotatably hold the cylindrical powder chamber, the end cover including a first opening and a second opening, wherein the window is positioned in the axial end portion on the first side of the cylindrical powder chamber, and positioned in a portion of the cylindrical powder chamber covered by the end cover, and the first opening and the second opening to guide external light into the axial end portion of the cylindrical powder chamber, and the light from inside the cylindrical powder chamber to the outside of the axial end portion of the cylindrical powder chamber.

10. The powder container according to claim 9, wherein the first opening and the second opening are disposed to face each other at a position lower in a direction of gravity than a center of the end cover when viewed from the axial direction of the powder container.

11. The powder container according to claim 1, wherein the end cover includes a retaining hole to be engaged with the retainer of the image forming apparatus.

12. The powder container according to claim 1, wherein the powder container includes toner as the powder therein.

13. The powder container according to claim 1, wherein a diameter of the cylindrical powder chamber at the scooping portion is less than a diameter of a remaining circumferential area of the cylindrical powder chamber, and the end cover covers an area of the scooping portion such that the protrusion does not contact with an inner surface of the end cover.

14. A powder container for use in an image forming apparatus, the powder container comprising:

a cylindrical powder chamber for containing powder for forming images, including an opening on a first side in an axial direction of the powder container;

a conveyor disposed within the cylindrical powder chamber to transport the powder contained in the cylindrical powder chamber to the first side from a second side in the axial direction; and an end cover to cover the first side of the cylindrical powder chamber, and to rotatably hold the cylindrical powder chamber, wherein the end cover includes a retaining hole to be engaged with a retainer of the image forming apparatus, and wherein the retaining hole includes a through hole penetrating in a direction substantially perpendicular to the axial direction, and the retainer is configured to penetrate the through hole and face an outer circumferential surface of the cylindrical powder chamber through the through hole.

15. The powder container according to claim 14, wherein the retainer moves upon contact with the outer circumferential surface of the powder chamber.

16. The powder container according to claim 14, wherein an axial end portion on the first side of the cylindrical powder chamber comprises a scooping portion to scoop up powder inside the cylindrical powder chamber by rotation of the cylindrical powder chamber, an inner circumferential surface of the scooping portion extends inward in the cylindrical powder chamber.

17. The powder container according to claim 14, wherein the conveyor comprises a spiral protrusion projecting inward from an inner circumferential surface of the cylindrical powder chamber.

18. The powder container according to claim 14, further comprising:

a nozzle receiver provided in the opening of the cylindrical powder chamber, the nozzle receiver having a nozzle connecting opening that receives a conveying nozzle of the image forming apparatus to transport powder from the powder container to the image forming apparatus; and a shutter to close the nozzle connecting opening.

19. The powder container according to claim 14, further comprising a window formed with a light transmissive material in at least a part of the cylindrical powder chamber in the axial direction thereof, the window to transmit light through the cylindrical powder chamber in a direction perpendicular to the axial direction.

20. The powder container according to claim 14, wherein the powder container includes toner as the powder therein.

21. An image forming apparatus comprising:

an image forming unit to form images on recording media; and a powder container comprising:

a cylindrical powder chamber for containing powder used for forming images, including an opening on a first side in an axial direction of the powder container;

a conveyor disposed within the cylindrical powder chamber to transport the powder contained in the cylindrical powder chamber to the first side from a second side in the axial direction;

a protrusion radially projecting from an outer circumferential surface of the cylindrical powder chamber at the first side, the protrusion disposed in a circumferential area of the cylindrical powder chamber, wherein an axial end portion on the first side of the cylindrical powder chamber comprises a scooping portion to scoop up powder inside the cylindrical powder chamber by rotation of the cylindrical powder chamber, an inner circumferential surface of the scooping portion extends inward in the cylindrical powder chamber, and the protrusion projects outward from an outer circumferential surface of the scooping portion; and a facing member to face the outer circumferential surface of the cylindrical powder chamber of the powder container, wherein the facing member extends towards and faces the outer circumferential surface of the cylindrical powder chamber such that the facing member extends within a radius of revolution of the protrusion, the protrusion contacts the facing member when the cylindrical powder chamber rotates in an attachment state with the image forming unit thereof.

22. The image forming apparatus according to claim 21, further comprising:

a powder replenishing device that includes the powder container including a window formed with a light transmissive material in at least a part of the cylindrical powder chamber in the axial direction thereof;

a conveyance member to transport powder from the powder container to a destination;

a light-emitting element to emit a light into an interior of the powder chamber through the window of the powder container;

a light-receiving element to receive the light emitted from the light-emitting element which travels inside the powder chamber, and to be facing with the light-emitting element through the window in a direction perpendicular to the axial direction; and a powder amount detector to detect an amount of powder remaining in the cylindrical powder chamber based on a detection result generated by the light-receiving element.

23. The image forming apparatus according to claim 22, wherein the facing member is formed with a transparent material.

* * * * *